US009010002B2

(12) United States Patent
Popa-Simil

(10) Patent No.: US 9,010,002 B2
(45) Date of Patent: Apr. 21, 2015

(54) METHOD AND ACCESSORY DEVICE TO IMPROVE PERFORMANCES OF BALLISTIC THROWERS

(71) Applicant: Liviu Popa-Simil, Los Alamos, NM (US)

(72) Inventor: Liviu Popa-Simil, Los Alamos, NM (US)

( * ) Notice: Subject to any disclaimer, the term of this patent is extended or adjusted under 35 U.S.C. 154(b) by 0 days.

(21) Appl. No.: 13/757,500

(22) Filed: Feb. 1, 2013

(65) Prior Publication Data

US 2014/0215876 A1 Aug. 7, 2014

(51) Int. Cl.

| | |
|---|---|
| ***F41C 27/22*** | (2006.01) |
| ***F41J 5/10*** | (2006.01) |
| ***F41A 19/08*** | (2006.01) |
| ***F41A 21/36*** | (2006.01) |
| ***F41A 25/00*** | (2006.01) |
| ***F41G 3/06*** | (2006.01) |
| ***F41G 3/08*** | (2006.01) |
| ***F41G 3/12*** | (2006.01) |
| ***F41G 3/14*** | (2006.01) |
| ***F41G 3/16*** | (2006.01) |

(52) U.S. Cl.

CPC . *F41C 27/22* (2013.01); *F41J 5/10* (2013.01); *F41A 19/08* (2013.01); *F41A 21/36* (2013.01); *F41A 25/00* (2013.01); *F41G 3/06* (2013.01); *F41G 3/08* (2013.01); *F41G 3/12* (2013.01); *F41G 3/142* (2013.01); *F41G 3/165* (2013.01)

(58) Field of Classification Search

CPC ..... F41C 27/22; F41J 5/10; F41A 19/08; F41A 21/36; F41A 25/00; F41G 3/06; F41G 3/08; F41G 3/12; F41G 3/142; F41G 3/165

USPC ..... 42/1.06, 90, 94, 97, 98; 89/37.04, 89/37.08, 41.01, 41.05, 41.17, 42.01; 235/414, 417

See application file for complete search history.

(56) References Cited

U.S. PATENT DOCUMENTS

| | | | | |
|---|---|---|---|---|
| 3,798,796 | A * | 3/1974 | Stauff et al. | 434/20 |
| 5,067,268 | A | 11/1991 | Ransom | |
| 5,136,923 | A | 8/1992 | Walsh, Jr. | |
| 7,552,557 | B1 * | 6/2009 | Mabry | 42/72 |
| 8,474,161 | B2 * | 7/2013 | Cunningham | 37/403 |
| 8,505,230 | B2 * | 8/2013 | Kossett et al. | 42/94 |
| 8,516,941 | B1 * | 8/2013 | Oliver | 89/14.4 |
| 8,555,766 | B2 * | 10/2013 | Garrett et al. | 89/27.12 |
| 2002/0007581 | A1 | 1/2002 | Bucciarelli | |
| 2009/0277068 | A1 | 11/2009 | Lamar | |
| 2010/0071246 | A1 | 3/2010 | Vesligai | |
| 2010/0077647 | A1 | 4/2010 | Kraft | |

* cited by examiner

*Primary Examiner* — Bret Hayes

(57) ABSTRACT

An accessory device for a ballistic thrower/launcher that can be handgun or a gun or other object throwing or launching device that is meant to improve the quality of the action, the comfort and safety of the operator. It is made of accessory devices that stabilize the operation of the throwing device aligning the recoil with the projectile trajectory making the process reproducible, predictable and controllable. It adds environment monitoring electronics, cameras and actuators, for accurately launching after aiming, considering all the major process perturbations, as movements, wind, humidity, atmospheric pressure, target movement, shooting post movement, etc. The device adds other features of safety for the operator, as stealth action, dimming process noise, recoil shock, flames and heat signature being suitable for remote operation.

15 Claims, 25 Drawing Sheets

METHOD AND ACCESSORY DEVICE TO IMPROVE PERFORMANCES OF BALLISTIC THROWERS

STATEMENT REGARDING FEDERALLY SPONSORED R&D

This invention was made with NO Government support.

NAMES OF PARTIES TO A JOINT RESEARCH AGREEMENT

This work was part of research of a single inventor.

CROSS REFERENCE TO RELATED APPLICATIONS

This application claims no priority.

BACKGROUND OF THE INVENTION

1. Field of the Invention

The present invention relates to a method and device to increase the comfort and quality of the small arms (generic handgun, rifle, crossbow, or any other throwing/launching device using passive projectiles) usage which provides better target visualization and analysis, more accurate firing at longer range, less accuracy-disturbing recoil, less shock, and powder contamination exposing the shooter to minimal enemy fire by using remote visualization and gun-holder extenders, or installing the gun on a remote controlled device. It is equipped with a set of target visualization and analysis devices showing the image remotely and in the shooter's goggles, giving a multidimensional gun-view used in accurately aiming, that makes handguns as accurate as rifles for distances under 1 km, and rifles up to 3 km dependent on ammunition type. It extends the practical usage of the ballistic thrower/launchers up to 90% of the safety paraboloid.

It has an auxiliary gun support device that smoothes the recoil, and cancels the recoil induced gun's rotational moment, during the bullet acceleration in the barrel. The device also collects the fire, powder, and used cartridge cases making the gun use more comfortable. Based on a range tinder, weather local measurement and ballistic data a firing angle correction is applied, in order to make the bullet reach the aimed spot.

The device may be installed in a remote location and be remote controlled or may be transported near the target by light, small moving platforms. Optionally it may be built with pattern analysis and firing authorization preventing friendly fire. The device is compact, easy to dismantle, reinstall and is easily deployed. The calibration of each individual gun is made using a specialized target with ballistics multi-parameter measurement capability, and by a specialized balancing system in order to position correctly the center of mass.

2. Description of the Prior Art

Policemen and other law enforcement personnel often encounter violent offenders, who carry pistols, rifles and other weapons and plenty ammunition. In addition, military operations often occur in urban areas requiring soldiers to patrol towns and cities. During patrol police and military personnel often encounter enemy fire and must take cover behind cars, houses, buildings and fire their weapons at close or medium range around such structures which often obliterate a clear, linear view of the target.

In such instances it is advantageous to have a weapon which will increase visibility around shielding objects, that is, the ability to fire a weapon accurately around the corner of a building or other obstacle without exposure in a most comfortable seamless manner, intending to deny target's aggressive actions, in a less lethal mode assured by its high firing accuracy.

Guns and ballistics are among the most studied and largely known in depth domains, therefore I will only describe at the basic level the elements this patent aims to improve.

FIG. 1 shows in a schematic view the actual details of the physics of a handgun firing. The hand 101 is represented up to the wrist, in spite of some contribution to the moment of inertia given by the arm up to the elbow. It shows the magazine, inside the grip, 102, loaded up to the top with ammunition, 104-105, from where the last cartridge, 103 is missing because the first cartridge 108 was loaded in the tube and all ammo was incrementally advanced towards the barrel 109. In that position the finger 107 is pressing the trigger 106 and is initiating the chemical reaction in the propellant. Commonly, the cartridge contains a propellant, a case and a bullet that is usually made of a solid mass uniformly distributed with known aerodynamics. The case of "dum-dum" munitions containing explosives and penetrators is ignored for these calculations.

After the cartridge is triggered, the gunpowder burns, building up pressure 121 behind the bullet 108, that starts moving and accelerating into the tube, driven by a continuously varying force that is given by the pressure multiplied by the barrel cross section. At one end the pressure acts on the bullet, accelerating it, and at the other end it acts on the bottom of the firing chamber generating the recoil force. All the fine details that are present in this process, as spinning, bouncing, forward gas leakage, gas cushion oscillations, gun's eigenmodes and deformations are ignored for simplicity reasons and because the present patent does not bring any improvement to those ignored effects. At the end of the bullet's acceleration process, that takes a little bit more than the barrel length's $l_0$ to the bullet flies out with the speed $v_0$. Considering the acceleration process uniform (with the same acceleration a along the barrel's axis) for simplicity reasons, we may calculate the average force acting on the bullet and on the gun creating its recoil.

Formulas used to describe this process are:

$$a = \frac{v_0^2}{2l_0}, \rightarrow F = \tag{Eq. 1}$$

$$m_b a = m_b \frac{v_0^2}{2l_0}, \rightarrow t = \frac{l_0}{v_0}; \rightarrow M = F_r(F_r = -F) \times b_r;$$

$$\Delta\alpha = \omega t = \frac{M}{I} t = m_b \frac{v_0^2}{2l_0} \frac{l_0}{v_0} \times \frac{b_r}{I} = \frac{m_b v_0}{2} \times \frac{b_r}{I} = I_b \times \frac{b_r}{2I}$$

and $$I = \int_{Handgun} \rho(r) r^2 \, dV \tag{Eq. 2}$$

where:

a is the calculated average acceleration of the bullet, $v_0$ 113, is the bullet's velocity at the gun's barrel exit, $l_0$ 115, is the length of the gun barrel, $m_b$ is the bullet's 110, 111 mass t is the acceleration time inside the gun barrel $M_r$ 125 is the torque in the arm that acts in vertical and horizontal directions $F_r$ 123, is the recoil force in the gun that creates the torque $b_r$, 124 is the torque's arm and has a vertical and horizontal component $\Delta\alpha$, 117 is the angle deviation of the gun's barrel axes when the bullet leaves the gun, having a vertical component and a slight horizontal component created by the mass difference between the hand 101 mass on one side and the fingers 107 mass on the opposite side of the gun's handler 102.

$\omega$ is the gun's angular average speed, $I_b$ is the bullet impulse and

I is the Moment of Inertia of the hand-gun assembly, calculating by integration of the mass density $\rho(r)$ multiplied by radius r squared, in all the volume of the active part of the body (the hand, the wrist, the arm, etc.) and the gun, according Eq. 2. The weighting coefficients have been omitted for simplicity reasons, as well as body-hand response functions.

A sample of calculation is given in the Table 1 below:

TABLE 1

| | | | |
|---|---|---|---|
| Gun parameters | $l_0$ = 4" = 10 cm | $M_{gun}$ = 2 kg | $b_r$ = 5 cm |
| Bullet's parameters | $M_b$ = 50 g | $M_{cartridge}$ = 250 g | |
| Gun-bullet parameters | $v_0$ = 250 m/s = 820 ft/s | | |
| Hand parameters | $M_{hand}$ = 5 kg | $\rho$ = 1 g/cc | |
| Calculated parameters | I = 1 kgm$^2$ | $I_b$ = 1.25 kg m/s | t = 0.4 ms |
| a = 312,500 m/s$^2$ $\Delta\alpha$= 0.078 rad = 4.48 grd | F = 15,625N | $M_r$ = 781,25 Nm | $\omega$ = 7,812.5 rad/s == 4,476.233 grd/s |

The force is not something to withstand, being by a factor of 20 bigger than an average man's body weight for a 50 g bullet and only by a factor of 2 times bigger, for a 5 g bullet, but with a duration of only ¼ ms, therefore the gun switches the position by 1-10 degrees on average, depending on ammunition during the internal ballistics phase. The nominal amplitude of gun rotation may be as high as 30 degrees, due to supplementary muzzle recoil and inertial forces and the reaction forces involved in stopping the gun rotation. The recoil speed of a gun is in the range of few m/s, depending on the masses (bullet, cartridge) involved. Has to be said also, that a 50 g handgun bullet is a rare case for special bullets made of DU, gold, tungsten or combinations and propelled with fast explosives; the average handgun bullet's mass is usually in the range of 5-10 grams using subsonic speeds, and very rarely ultrasonic speeds.

FIG. 3A shows transonic speed domain is very heterogeneous from the point of view of the drag force, driving to instabilities and to a hard estimation of external ballistics, therefore is seldom used. In fact if the bullet's speed is a little bit over 1 Mach the advantage is immediately lost, but the propellant mass and bullet's noise is increasing accordingly. The efficient use of ultrasonic bullets is over 1.8 Mach up to 3 Mach, and that is mainly obtained in rifles and guns with long barrel, for which the center of mass corrections we envisage for handguns are not so drastic as for handguns and all the rest of correction, and adjustments remain in place.

In general practice the gun deflects by few degrees on vertical (supposing normal shooting position) about ¼ of that range on horizontal towards the interior of the hand.

The skill in aiming well is gained by practice that teaches the shooter how to compensate for these effects. Number of cartridges in the gun loader modifies the moment of Inertia and as consequence the deflection angle and that is yet another accommodation the shooter has to consider and overcome. These abetments from the optical aiming direction are inside acceptable limits for short range applications under 100 ft, but makes the handgun unpractical at higher distances, in spite of the fact that the bullet may fly up to 2 Km, having enough energy left after traveling a distance greater than 500 m. Of course target gun accommodation is required.

The table 2 gives the flying distances for various types of ammunition from US government firing tables:

TABLE 2

Maximum firing range for handguns with various cartridges

| Cartridge | Max Range (yds) |
|---|---|
| .22 RF (40 gr) | 1530 |
| .223 (M193) | 3390 |
| .223 (M855) | 3760 |
| 243 (100 gr) | 4750 |
| .264 Win (140) | 5130 |
| 7 mm Mag (175 gr) | 5420 |
| .30-30 (170 gr) | 2490 |
| .308 (M80) | 4480 |
| .308W (M118) | 5780 |
| 30-06 (180 gr) | 5320 |
| 30 M2 Ball | 3500 |
| 12 ga Slug | 1200 |
| .300W Mag (200 gr) | 5930 |
| 9 mm M882 | 1970 |
| .38SPL + P (158 gr) | 1780 |
| .357 (158gr) | 1950 |
| .45ACP M1911 (230 gr) | 1850 |
| .40S&W (180 gr) | 1800 |
| 375H&H (270 gr) | 3370 |
| .45-70 (500 gr) | 3220 |
| .458W (500 gr) | 3620 |
| .50 BMG AP M2 | 6670 |
| M903 SLAP | 8700 |
| 120 mm M829 APDS | 113,000 @ 55° |

It is seen as the weakest actual guns deliver a significant hit over 1 km, and if accurately used it may accomplish the concept that the most important fact is momentary enemy's action denial, not enemy killing, because in the future it may become a reliable ally.

This effect makes that if initially aiming on initial direction 112, alter pressing the trigger 105 the gun rotates making the moving bullet 110 scratch the lower part of the barrel, while leaking hot gases forward, making an accelerated differential wear, on those sides, and when the bullet leaves 111 the firing tube 109 has the speed 113 pointed after a direction different by $\Delta\alpha$ 117 from the initial direction 112.

The firing range continuous observation is further made impossible by the burning powder escaping from the end of the barrel 116, forming the flare, and the inertial rotation of the handgun due to its recoil that sets off the aiming visualization direction and independent observer is needed.

Another unpleasant incident during firing a handgun is the release of hot gases from the firing chamber 119, very dangerous for older models of handguns. The noise and chemical pollution are another few inconvenient of the actual handguns.

The most common shooting recommendation is to hold strongly the gun in hand, far from the face, but that is not possible in all fighting environments. The use of the actual aiming devices is a hazardous operation in an active battlefield because it requires that a large part of the shooter body to be exposed to enemy fire while aiming. For the small handguns the wind deflection and "Magnus effect" due to bullet's spinning in cross-wing is usually ignored due to other larger inaccuracy of the whole process, but when this handicap is eliminated using the invented accessories, these corrections will become important, and it is supposed to be performed.

The conventional methods and military practice for handgun shooting require a significant amount of labor intensive activity with high hazard and are many times of questionable quality and questionable result compared with the initial desired planned outcome. This process is time consuming and poses a significant impediment to shooter health's, in terms of safety hazards. This process is also a problem in that many people are exposed to potentially harmful chemical substances, used in propellant (gun-powder) manufacturing that inhaled in small amounts drive to brain and metabolic disorders and other undesired self-exposure to various hazards. Typically, one or more people have to work together to assure the quality of the desired outcome.

U.S. Pat. No. 7,552,557 B1 discloses a method to adapt a handgun to shoot around the corners with minimal shooter's exposure made of a pivotable shoulder stock for use in combination with a handgun that includes a mirror and allows the user to aim and fire an equipped laser handgun around the corner of a building or other obstacle. The user is able to fire with relative accuracy from behind a building or other obstacle using the mirror attached to the shoulder stock. The mirror can be adjustably positioned for viewing in order to tire the handgun at about a ninety-degree (90°) angle in either a clockwise or counterclockwise direction. The mirror can be revolved to a downward posture when firing the handgun in a linear direction similar to a rifle or for storage purposes. The pivotal shoulder stock is relatively simple to operate and can be quickly adjusted by latching the second section against the first section for use as a hand weapon rather than being shoulder fired. One weapon of choice is a pistol mount in the form of a shoulder stock having an attached mirror. Such a device is the Israeli Corner Shot™, which utilizes a color video monitor, folding stock and various other accessories.

Due to the many high-tech electronic components employed, the price of the Israeli Corner Shot™ is often unaffordable for many small police departments. Repair and service can also make the Israeli Corner Shot™ impractical. Thus, based on the needs and budgets of law enforcement departments, the present invention was conceived and one of its objectives is to provide a pivotal shoulder stock for a standard handgun having a laser-aiming device. FIG. 2G shows a top, rear, right side perspective view of a pivotal shoulder stock of the invention with the handgun 60 section rotated counterclockwise as viewed downwardly from the front approximately sixty degrees (60°) with the handgun and laser exploded there from, in order to better understand its operation, turning now to the drawings, preferred shoulder stock 264 as seen in FIG. 2G having handgun section 274, first shoulder section 275 and second shoulder section 277. Second shoulder section 277 is in linear alignment with and pivotably joined to first shoulder section 275 by attached hinge 278 and is seen locked in place by rotating latch 279 and latch pins 276, 286. As seen in FIG. 2G, second shoulder section 277 can be pivoted (folded) against first shoulder section 275 and latch 279 rotated to contact latch pin 276 to maintain shoulder stock 264 in a shortened posture. Second shoulder section 277 is shown unfolded and fully extended whereby latch 279 can be pivoted to contact latch pin 286 to maintain shoulder stock 264 in this extended posture. First shoulder section 275 and second shoulder section 277 are preferably formed from generally planar metal such as aluminum although steel or other suitable composites or polymeric materials could likewise be used. The weight of shoulder stock 264 is reduced by the series of openings shown therein. Second shoulder section 277 includes pin opening for receiving latch pin 286 when second shoulder section 277 is folded against first shoulder section 275. F handgun section 274 is shown in FIG. 20 rotated about hinge 273 at an angle of about sixty degrees (60°) from first shoulder section 275 for aiming and firing for example at targets which are located at about sixty degrees (60°), such as around a building, corner or other obstacle. In order to view the target, mirror 268 is provided and is rotatably positioned atop hinge 273 and rotatably affixed to extension 274. Mirror 268 is vertically rotatable about extension 274, which is horizontally rotatable about hinge 273 allowing mirror 268 to be rotated to a variety of positions. For aiming handgun 265, mirror 268 as illustrated in the figure is manually positioned at different angles as desired depending on the exact alignment of handgun section 274 relative to first shoulder section 275. Second shoulder section 277 may be positioned against the user's shoulder (not shown) during use of a handgun such as handgun 265 shown with laser device 267.

The pivotal connection of first shoulder section 275 and handgun section 274 has circular crank and disk 273. Disk 280, hinge 273 and lucking pin is selectively positioned within handgun's 265 sleeve on first shoulder section of 274 and can be inserted through one of a plurality of pin apertures in disk 280 rigidly affixed to handgun section 274 such as by welding or the like. By manual operation of locking pin linkage, which includes finger tab 265, linkage rod, L-shaped pin lever, a coil spring and locking pin, can be released for pivoting relative to first shoulder section 275. In operation, the user (not shown) depresses finger tab thereby pulling linkage rod causing pin lever to rotate thus extending coil spring and raising and disengaging locking pin from pin aperture in disk 280. Shoulder stock 264 can also be adjusted to a linear configuration and latched in place by latch 279 and latch pin 286 for using handgun 265 like a rifle. In this position mirror 26K is rotated about extension to a downward posture adjusted as required to a proper length for tiring purposes. Trigger mechanism 269, 266 includes stock trigger 269 pivotably affixed to first shoulder section 275 by trigger axle. Trigger spring is a conventional coil spring affixed to stock trigger 269, which includes rod opening for reception of the proximal end of first rod 270. First rod 270 has an L-shaped proximal end, which passes through stock trigger 269. First rod 270 as seen is configured having a bent distal end, which passes through one of selected crank apertures 271 in the crank and is preferably formed from a rigid steel as is second rod 272 which is connected to magnetic connector having permanent magnet therein. By employing magnetic connector a user in the field can easily connect, adjust or remove second rod 272 from crank and trigger lever 265 which contacts trigger 266 of handgun 265. A conventional eyehook is affixed to handgun section 274 for maintaining second rod 273 relative thereto.

This device, and the Israeli "corner shot" device have the disadvantage or being too complicated for being successfully used in the battle field, requiring the operator make many adjustments, and due to many hinges, and articulations that need proper adjustment the firing accuracy is reduced, requiring longer response times. The usage of the mirror is reducing the aiming useful image, is sensitive to dust and misalignments, while the electronic camera and display have to be previously tuned with the handgun, being sensitive to vibrations and gun's recoil, that is amplified by the displacement of weight and inertia moments in the articulated arm.

U.S. Pat. No. 3,798,796 describes an automated system for rapidly training operators required to accurately aim an optical instrument at a stationary or moving target. It consists in equipping the optical aiming instrument handled by the trainee with a television camera to which is associated a reticule the optical axis of which is sighted with that of the optical instrument. A device for displaying the images analyzed by the camera and reticule is available to an instructor so that this latter may give useful advice to the trainee during his aiming operations. It does not solve the problem of accurately hitting the target, in real time.

There are many known aiming systems; for example, the aiming systems in the patent US 2010/0077647A1 that can be used to aim any firearm. The aiming systems can comprise a front sight portion having a cross-section with a truncated triangle shape when viewed by an operator aiming the device. The aiming systems can further comprise a rear sight portion including a notch having a truncated triangle shape with a base, a left side, a right side, and an opening that is narrower than the base. The front sight portion is alignable relative to the notch for aiming the device; others are developing recoil suppression devices as the patent US 2010/0071246 A1 that consists in a stock assembly for attachment to the receiver of a shotgun is described. The assembly includes a pistol grip; a stock; a connector tube slidable within a conduit in the stock, the stock and connector being selectively lockable to each other; an attachment member slidable within the tube conduit between fully inserted and fully extended positions; a first elongated connector attached to the attachment member and extending parallel to the longitudinal axis of the tube into attachment with the pistol grip; a second elongated connector extending from the pistol grip into engagement with the receiver, the second member being at an angle to the first member; and a compression spring in the tube conduit urging the attachment member toward its fully extended position.

Other inventors consider that the origin of shooting inaccuracy is due to human body instability and propose ground bases firing supports, as, for example the patent US 2009/0277068 A1 that adds a shooting stabilizer is disclosed having an arm support, a clamp, an optional connection member, one or more optional and securable pivoting means, an optional support leg, and one or more optional affixing means. The shooting stabilizer provides an arm support to stabilize the shooting arm of the shooter when shooting a firearm.

It is known that a good handgun or rifle rest with stop means for respectively releasing and stopping movement of both coarse and fine elevation adjustments and shafts and handles for manipulating the stops as those proposed starting with the U.S. Pat. No. 5,067,268 may improve firing accuracy in side the usable ranges of the firearms. The shafts and handles of the elevating mechanism stops, which are outboard of the hub region of the rest, are Fabricated from hollow tubing to reduce their mass. An adjustable bias in the releasable stop for the coarse elevation adjustment is provided to control manipulation of the is adjustment.

There are many people that believe that better aiming accessories may bring better accuracy, as for example the patent US 2002/0007581 A1 that introduces a firearm accessory modification to a removable or fixed scope mount of a firearm or a removable or fixed top cover of a firearm. The modification consists of strategically located and drilled holes through a removable or fixed scope mount or drilling holes through a mounting block attached to a removable or fixed top cover. Purpose of said drilled holes is to allow the use of conventional pushpin style brass-catchers, pushpin style flashlights, and/or lasers. FIG. 2A shows such an example of "corner shoot" equipped handgun 201, having an range-tinder and aiming device 204 over the gun 201, using the gun's normal aiming rear 209 and front 208 devices mounted on the top of the gun, and using a laser pointer and target illuminating device 202 positioned under the gun. The system of coordinates 210 is given as a reference for gun movement in space. The shooter 206 positions the eye along the upper sighting line 207 using the advanced optic gun sight 204, mounted on a gun adapter 205, and having knobs for ballistics and wind corrections. The bullet's trajectory is along the borehole centerline 211 and has two phases: an internal ballistics from the triggering moment until it leaves the muzzle also called the initial point of the external ballistics.

During the internal ballistics, along the bullet's trajectory inside the gun that takes a time less than 1 ms, a initial recoil is produced and the initial aiming is modified by an angle $A\alpha_y$ 212, that is a rotation upwards due to the torque created by the pressure inside the borehole acting on the end of the hole that is above the center amass, and a rotation $A\alpha_z$ 213 due to the fact that the center of mass is off axis depending on hand grip style and hand consistency, and a backward recoil $\Delta z$ 214, typically of few mm during the internal ballistic process duration. The linear recoil is irrelevant for accuracy loss but the two rotation movements which may be as high as 5 degrees and variable from round to round is very important and not corrected by the actual systems. That is why the actual handguns are used most frequently under 50 yards, curve F, being possible to use up to 200 yards curve P, 307, as FIG. 3B shows.

High accuracy repetitive shooting, is very difficult and "double-tap" procedures requires long training with the same gun, same ammunition and is mainly due to muzzle deflection produced by the propellant gases release outside the gun barrel, that is even stronger that the gun deflection from initial aiming due to internal ballistics process.

There are various techniques developed to dim this effect, that have both advantages and disadvantages and main developments are:

A flash suppressor mixes air with muzzle gases to reduce muzzle flash.

A brake has surfaces that deflect muzzle gases backward to reduce felt recoil, but increases the acoustic shock by more than 15 dB, bringing it over 160 dB.

A compensator has surfaces that deflect muzzle gases upward to reduce muzzle flip, but reduces the target visibility and makes the shooter inhale the toxic gases and get powdered with gunpowder.

Many muzzle devices combine several of those functions and here you are some examples:

An A1 "birdcage" flash suppressor is just a flash suppressor.

An A2 "half birdcage" flash suppressor is a flash suppressor combined with a compensator.

An AK74 muzzle device combines brake and compensator, but does not reduce flash.

Noise suppressor that reduce the shock wave and sound of the gun as that described in the U.S. Pat. No. 5,136,923 which includes an outer housing, an interior perforated tube located within the outer housing, and spacing between the outer housing and interior perforated tube, being adapted to be mounted on a firearm.

All the above solutions have many disadvantages that have been eliminated by the device according to the present invention, that aims in aligning the recoil direction with the gun's axis only and capture the gases and eliminate in the environment in an ecological friendly manner, reducing the pollution.

The previous shooting methods are limited in range due to practical inaccuracy, and the electronic improvements at such equipment would be little value added with the use of such equipment, which may explain why it has not been adopted for large-scale use, because is increasing the cost and complexity without increasing its performances in the context of poor understanding of the process behind and developing means to correct it.

SUMMARY OF THE INVENTION

The present invention is a ballistic thrower/launcher that can be a gun, hand gun, rifle, crossbow, accessory system that improves the shooting accuracy and shooting comfort, dimming the firing shock and pollution. The handgun is clamped-on mounted in a holder that has the role to align the moving part center of mass with the firing central axes, making unidirectional recoil that is dumped in a fluidic or magnetic device installed on a sliding structure frame. The frame is connected through joints that allow the turning on horizontal and vertical direction with center in the end of the gun tube, after the muzzle in order to be simple to maneuver in narrow environments. The movements are used to perform gun-firing corrections for range, target and shooter movement, and for atmospheric conditions. A set of imaging systems connected to a computing unit is used to find the range and enhance the target visualization, applying the corrections to horizontal and vertical actuators as a function of gun type, ammunition used and weather information added to target information. The sub millisecond recoil shock is dimmed by two orders of magnitude by the recoil-dumping device that may be also used to create a micro-wind flow to cool down the gun and vacuum to collect and absorb the gunpowder and prevents it from spreading allover.

The present invention includes an array of sensors to detect the type of ballistics as well as measure the parameters needed to assure a high quality execution with minimum, possible, negative impact. Also included are a set of devices to assure a high quality of shouting and shooter's comfort as gun-view systems, night view, passive and active range finder, atmospheric measurement unit, electro-magnetic field array measurement, radar-laser detectors, radar imaging, visible and IR-fingerprint minimization, remote visualization and remote handling by wire or wire-less, used caps collection, automatic balance, etc., Sound monitoring and sound source localization, specialized in detecting nearby flying bullets trajectory, and a supplementary geo-map information system will be a bonus, if by its nature does not become a distraction for the shooter.

It is therefore a primary object of the present invention to provide a rapid and accurate shooting which will significantly enhance the quality of this action, with minimum shooter hazard exposure.

It is another object of the present invention to provide a rapid assessment of the battlefield which will significantly enhance the convenience, of accurate intervention at a significant savings. The method relies on the fact that the gun accuracy and range can be dramatically improved if the recoil vector is aligned with the firing vector, and if the impulse is spread over a longer time, minimizing its amplitude. In order to allow shooter maintain a good perception over the surrounding environment the collateral shocks and pollution related to the firing have to be eliminated, focusing the attention on environment perception and its understanding. In many circumstances the safety of a shooter depend on its seamless presence in the environment and the device is using advanced camouflage techniques minimizing its visible, IR, acoustic and smell signatures. A feature of increased safety is using the advantage of terrain, without taking the exposure hazard by using one or more remote controlled tiny devices.

It is a further object of the present invention to provide a seamless intervention on moving targets by accurate fire delivery, using the weapon at its maximum parameters. It is known that even a less energetic bullet may deliver enough distractive damage in the aggressor body, preventing the momentary aggressor from involving in more aggressive actions that might trigger its elimination.

The automatic firing control system embedded in the device may extend the shooting range up to distances where the projectile remains with 10% of its initial kindle energy, and still effective enough for enemy actions denial.

It is still another object of the present invention to provide a rapid and accurate lire delivery system, that to use the terrain, and which would reduce human exposure to potentially harmful chemical substances, noise and enemy fire.

It is still a further object of the present invention to provide a rapid small arms shooting device much faster, cheaper, with higher quality, more safely.

These and other objects of the present invention, will become apparent to those skilled in this art upon reading the accompanying description, drawings, and claims set forth herein. The headings provided herein are for the convenience of the reader only. No headings should be construed to limiting upon the content in any way.

BRIEF DESCRIPTION OF THE DRAWINGS

FIG. 4F shows a schematic view section, of the propellant gas collector muzzle recoil reducer gas flow pattern an embodiment of the present invention

DETAILED DESCRIPTION OF THE INVENTION

Figure 1:
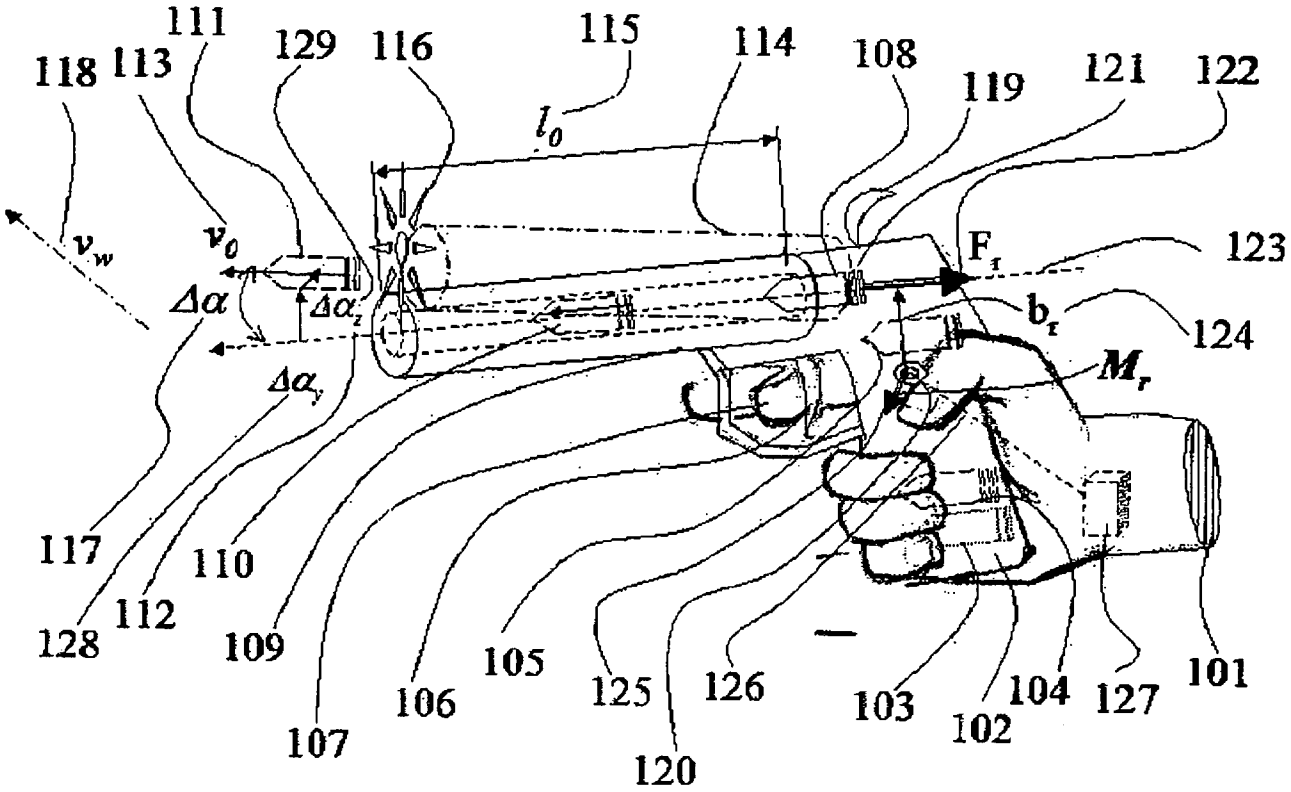
Prior Art Fig.1
FIG. 1 is a view of the actual state of the art in handgun firing, explaining how gun misalignment self-movements occur during internal ballistics time.

The inventor considers that the lack of accuracy of the guns is due to inappropriate recoil compensation, and to the lack of appropriate coordinates estimation for the target position in the moment of the rendezvous with the projectile. More the shooter's exposure to noise, gun powder, and heat reduces its comfort and makes the shooter a clear target for the enemy fire, therefore appropriate devices and functions have been developed as to be integrated in the device. Modern warfare technologies may expose the shooter to direct laser beams, therefore artificial vision that is immune to high beams have been developed, in spite Geneva convention banned these weapons, the military personnel and law enforcement forces remain exposed to such illegal use.

2. Best Mode of the Invention

FIGS. 4-10 shows a side sectional view of the best mode contemplated by the inventor of the handgun or other ballistic thrower/launcher improved firing and control accessories devices according to the developments embedded in the present invention.

The invention corrects the following previous deficiencies of the guns improving their performances:

a)—The shooting inaccuracy due to recoil induced gun's rotation due to internal ballistics, by applying a set of weights to move the center of mass in the center of the borehole.

b)—Rotation induced by escaped-gases pressure behind the bullet acting on muzzle that prevents accurate repetitive shooting deflecting the gun by preventing the gases to apply force perpendicular to the muzzle, and smoothly extracting them c)—Aiming inaccuracy due to poor vision of the target through the gun's sighting system by adding a zoom in camera system over the sighting devices.

d)—Shooting inaccuracy due to difficult compensation for ballistics and shooter-target movement, by adding a range finder, weather station and inertial base with target equation of movement acquisition applied to a ballistics calculator.

e)—Shooter exposure to enemy fire during sighting and shooting process by making possible that the visualization screen to be remote, or transmitted to shooter's TV goggles f)—Shooter exposure to gun's toxic plumes from the propellant, by adding a vortex collector to the gun gases, cyclone filter and remote evacuation of gases by mixing in atmosphere g)—Shooter car damage due to shooting shook waves, by attenuating the acoustic shock during burned gas collection.

h)—Shooter position disclosure due to visibility in visible, thermal and acoustic monitoring by adding complex camouflage devices that reduces the thermal signature and visible made of cooled surfaces and active displays as well shells collection and hot gas collection, filtering and disposal.

i)—Shooter exposure to enemy fire during a standoff necessity of gaining better shooting positions in terrain, to end the standoff without using the guns, by positioning the gun on remote-controlled displacement platforms j)—Execution control for quality assurance, and documentation issued, by using the gun vision system to track the bullet together with the accelerometer system measuring the recoil and speed dispersion for each bullet.

k)—Shooter control on the battlefield changes and warning systems by adding to the gun system Motion sensors, radar IR illumination detection systems ant acoustic bullet path tracking systems.

The best application of the invention is done by the sets of FIGS. 4-7 culminating with the set of multiple deployable multi-wheeled-pied remote controlled shooting-surveillance systems. There are also some applications that do not require such complex equipment, and a simplified version is presented in FIG. 8, that does not compensates for shooter's hand vibration, and its own movement having the firing characteristic described in FIG. 5A, that may have the additional gas collector or just a muzzle recoil compensator.

3. How to Make the Invention

As can be amply seen from the drawings the firing device is made of a gun support to accommodate both the center of mass position in front of the bullet on the center axis of the bore hole and its own recoil. One may simply think that moving the position of the handles and ammo will be good enough, but in reality it is not because the hand will have to take a shock force of few hundred kgf in less than 1 ms, which is damaging for the joints. A recoil dumper is needed and this interferes with loading unloading procedures, and that drove us to make a specialized gun rest having a dynamic inertia moment adjustment weights that will compensate the ammo mass variation. It is preferred that this weights to be useful parts of equipment and not additional weights. Then are the firing issues, because a zero range longer than 100 ft brings complications in compensating the bullet's drop during external ballistics, wind and target movement being other complications that requires lots of training and good momentary shape in order to perform well. In the present system this plus the hand oscillation is compensated by the electronic system, that has a complex calculation for the atmospheric conditions and target movement. In order to assure the shooter's safety in street combat, the first condition is not to expose itself to enemy fire, directly due to the necessity of aiming the gun in straight line to target, and here a camera with the image transmitted to a hand held screen have been added. In this moment the shooter still uses its hand to position the gun outside the corner or shield and his hazard exposure decreased, but still high in complex street battles tactical schemes.

The next option easy to develop in this structure was to use a hand extender made of a telescopic arm, which may position the firing box up to 10 feet away from the shooter, making easy for shooter to take a better shelter out or the reach of special ammunition. In order to minimize the shooter's exposure the box was equipped with stealth devices such as luminosity controlled displays that mimics the environment behind and cooling systems to reduce IR signature inside thermal monitored environments. The electronics associated is used in multiple purpose, from environment monitoring to target accuracy shooting and error compensation. The calculator will not shoot to a target that is out of range or placed in high variable winds, providing the shooter with predicted shooting quality information (probability of hitting the target). Other improvement brought to shooting act, is noise and gunpowder pollution suppression and used ammo tubes collection. Further, this application is provided with robotic moving capability, adding it on small power-train units with capability of transforming themselves in a tripod stable reasonable height shooting devices. More details are given in Figs detailed description.

Some simple derivatives of the invention may be developed and used in various simpler circumstances as described in FIG. 8 that are similar devices but doing less functions, having the advantage of being smaller, cheaper and more compact.

In practice, one has to take the handgun shooter wants to be suitable in this application and customizes the fixtures connecting the gun with the inertial compensation structure.

Figure 10B:
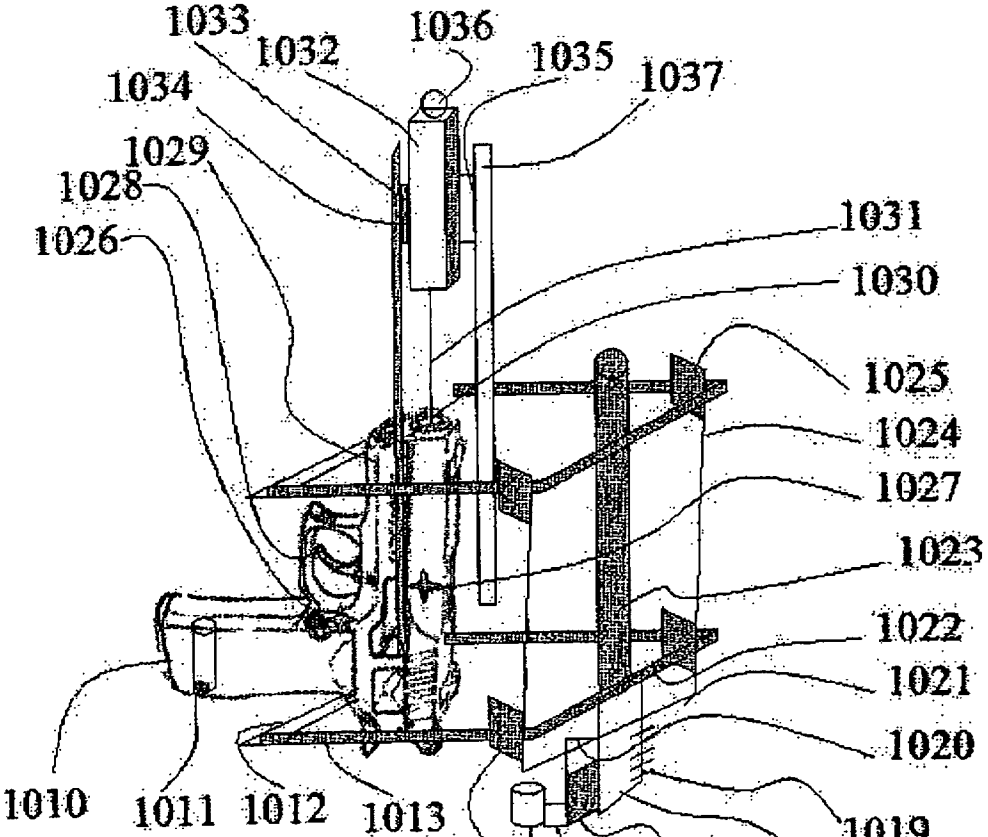
FIG. 10B shows a schematic view of a the accessory device mode of use to balance the gun assembly being another accessory device to the present invention.
Figure 10A:
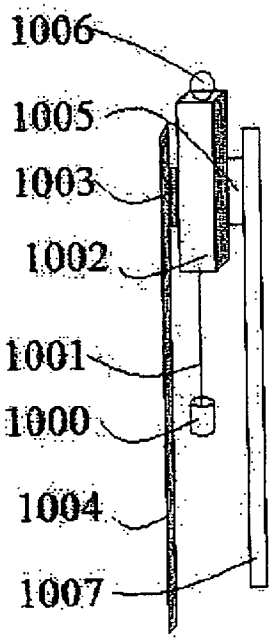
FIG. 10A shows a schematic view of a accessory device used to balance the handgun for initial calibration of the gun balance actuators, being another accessory device embedded into the present invention.

Take the device from FIG. 10A and introduces the gun holder in the gun barrel and hangs the gun of it, as FIG. 10B shows. For the beginning takes the gun completely loaded with bullet in the tube, and by smooth movement of masses available (lasers, cameras, etc) and supplementary balance masses brings the center of mass inside the firing tube, in front of the cartridge, and notes this position on the balance incremental actuators. After the position of all devices was clearly marked, one cartridge is extracted and the actuators are moved until a new position is reached where the balance is as desired, and that is also marked clearly. Another cartridge is taken out from the loader, and a new position is marked and so on until the loader is empty. With these markings the incremental actuator is adjusted as to be easy to balance the gun during the firing. For another type of ammunition the procedure is repeated and a new table of increments is generated, and so on until all the ammunition types are matched on the tables of increments. For various magazine capacities the procedure have to be repeated from the beginning. With these data, for any magazine and ammo used there will be a table of increments that can be used and the system balanced fast as a function of cartridges left in the magazine. This operation assures the collinear recoil and possibility of multiple fast shooting with a single aiming. The shooter will be made aware by any misalignment by the accelerometer sensor that measures the gun recoil during shooting.

With the operation accomplished by manufacturer or by shooter, the new stage of calibration has to be performed.

This might be not necessary, if the literature data are considered good enough and may be introduced in the ballistic calculator, but even in this cases a check-up of the gun's accuracy and well functioning is recommended.

Using the target frame described in FIG. 9 at a shooting range one or more frames may be used simultaneously. Supposing one may use 3 target-frames 900 may place one near the shooter, one at the mid-range and one at the end of the range. The gun's electronic system and the targets electronic systems are connected to the shooting range calculator that acquires all the data and calculates them all together in order to generate a coherent results.

The shooting frames according the present invention are immaterial detecting the passage of the bullet by measuring its crossing position speed and trajectory based on the reflection of a laser beam on the bullet simultaneously with the bullet shuttering a optical grid pass, that gives the x and y position and time. The zero time is when the fire command was launched, and gun's trigger was pressed in order to initiate all the sequence.

The last target may be loaded with opaque material stuff, as a paper or fabric reflective classical target, or various bullet-absorbing materials in order to simultaneously test the bullet's behavior in various targets. This system will generate the ballistic coefficients to be introduced in the gun's ballistic calculator, The presence of wing and the capability of targets to measure the wind speed and direction is another plus, for the generated data, making the ballistic set more complete. The format the ballistic coefficients are introduced in the gun's calculator is depending on the type of calculator used in the process, because various type of calculators may be used, from shooting ballistic tables, to little gaming like calculators as DS, Play station, pads or smart phones, to more sophisticated multiprocessor embedded computers. These data are used in the shooting systems in terrain where the data is introduced directly by sensors and or manually using a system as in FIG. 4 or its simpler version given in FIG. 8.

DETAILED DESCRIPTION OF THE FIGURES

FIG. 1 is a view of the actual state of the art in handgun firing, with emphasis on gun misalignment due to self movements induced by recoil during internal ballistics time. It was showed by average (where bullet's acceleration was considered constant) calculations that the variation of the aiming angle during the time taken by the bullet to leave the barrel, may be as high as 5° upwards, 1-2° lateral movement and up to ¼" backward movement, fact that is affecting the shooting accuracy. How much this means, depends on the aiming range, and FIG. 3C in the legend shows the bore centerline upward angle and the aiming distance for "Zero Range". In practice the recoil movements are even higher, because at the pressure relief in the muzzle the gun's effective, surface grows by a factor of 3 to 5 that makes the recoil of the gun higher in the range of tenths of degrees but that does not affect the bullet's trajectory. It affects the capability of shooter to tire multiple bullets accurately, and that is why the "double tap" or "hammer" technique where two well-aimed shots are fired at the same target in which the firearm's sights are not required by the shooter between shots, requires lots of practice with the same gun, until it becomes used off.

FIG. 1 is emphasis gun kinematics behavior during internal ballistic phase, when the bullet 108 accelerates from the trigger 107-106 moment until 110 it exits 111 the gun's 109 muzzle 116 improved by the present invention.

During this process, the propellant burns and builds up a pressure 121 between the accelerating bullet 108 and the gun's bottom generating a recoil force 122 equal and opposed to the bullet's accelerating force 110 and equal with the instant pressure multiplied by the effective surface of the gun's burning chamber. The lateral pressure's only effect is to stress the gun's barrel, without any recoil effect. The figure shows the total deflection angle 117 when the gun is leaving on another direction than the initial one 112, being composed of 3 independent movements the vertical deflection 128, the most important and the horizontal deflection depending on hand grip style, and the recoil. The figure also shows that the center of mass 120 position is variable depending on ammunition and hands grip, and how the moment of inertia is calculated using hand's contribution to the gun-hand assembly, while the stillness of hand joint gives the weight of the forearm contribution to the effective moment of inertia. The strengths of the hand grip and stiffness of joint is correlated with the hand's shaking due to human feedback system oscillating around the aiming position. The figure shows that the moment of inertia is calculated by summing the square of the distance 126 multiplied with the mass of the element of the volume cell 127, and usually is located off the firing axe, with a good reason—the comfort of shooting and avoid having to take a "head-on" recoil force, very damaging for the joints if not properly mitigated, and that is the best the actual guns concepts can do, and made possible our invention meant to improve these imperfections.

Figure 2A:
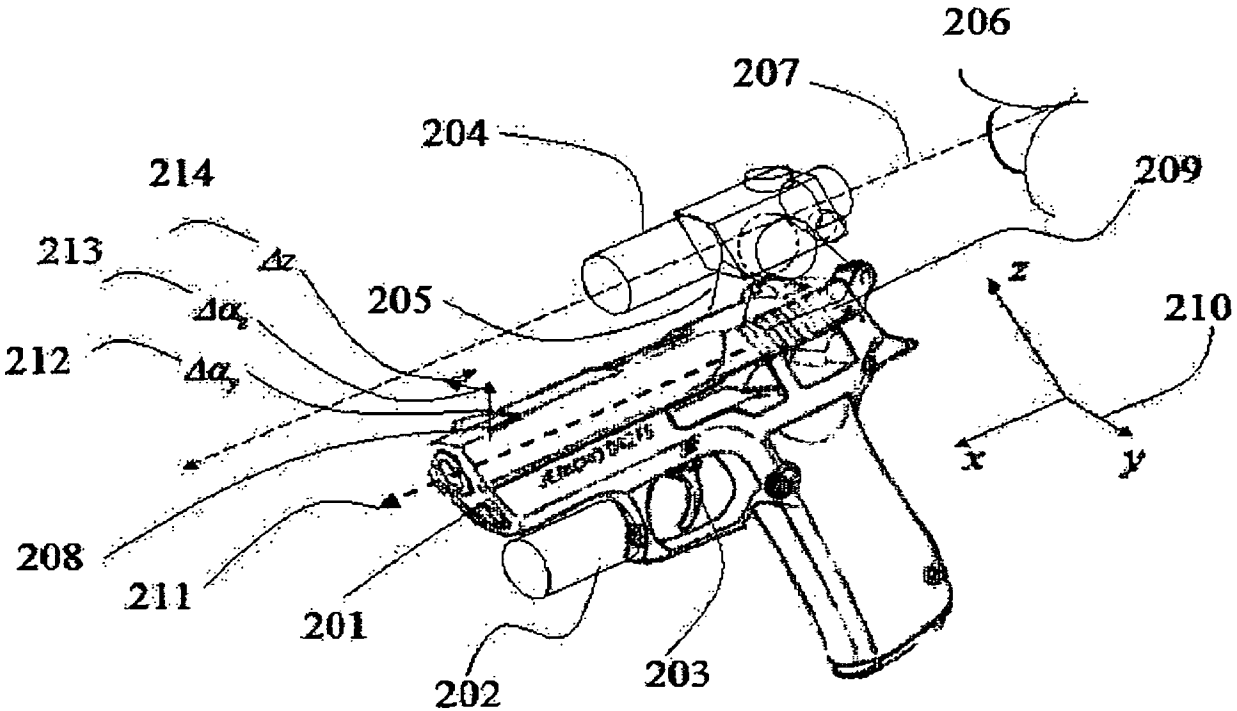
Prior Art Fig.2A
FIG. 2A represents the actual state of the art in handgun aiming and firing technology using gun adaptor devices tor enhanced aiming and target illumination.

FIG. 2A represents the actual state of the art in handgun aiming and firing technology using adaptive devices for enhanced aiming and target illumination. The actual concept in handguns use is that the firing range inaccuracy is due to poor visualization of the target during aiming, and different accessories have been added in order to improve this aspect. From the inventor's point of view this is only one side of a more complex problem.

The handgun 201 has built adaptors for hanging a laser-pointer 202 underneath and a target illuminator like a flashlight or an IR laser that may have also range-finder capabilities. The coordinates system 210 is given as an introductory reference of a more complex ballistic problem that will be further discussed. The handgun, it may be as well a gun, rifle or rocket launcher, has the bore centerline 211, that the bullet drives after, and classical aiming system made of a rear aiming 209 and a front aiming 208, and also it has an adaptor over the gun 205 where an sight viewer 204 may be attached. The shooter 206 may aim along the sight line 207 through the telescope device 204 or may use the classical aiming system 208,209 under the telescope 204 or the laser pointer 202, depending on circumstances. No matter the aiming choice, during firing the gun will experience a vertical drill 212, a lateral drill 213 depending on the grasp on the gun's handle, and a recoil 214, basically unaccounted for directly. The angular movement of the gun is what makes the shooting inaccuracy in spite of better visualization and there are some elements of external ballistics, compensated on the knobs added on the telescope 204 for wind and zero-range distance. In this system the most accurate firing is on horizontal, and targets placed at different heights being much harder to reach. Another inconvenient is the increase sensitivity to firing shock and transportation that may easily disqualify them. The present invention is correcting the internal ballistics induced firing drift and target aiming visualization, creating a device that enables the shooter shot without self exposure to enemy.

Figure 2B:
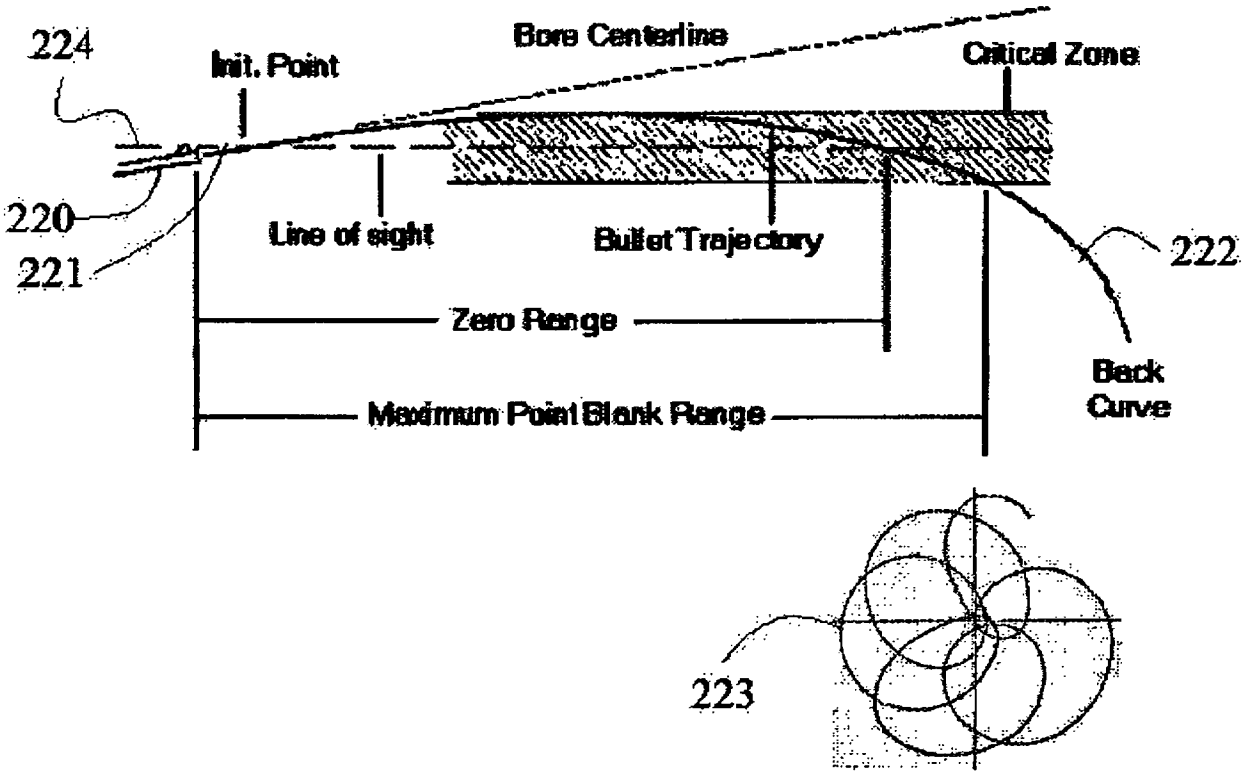
Prior Art Fig.2B
FIG. 2B represents details of the external ballistics in the actual guns

FIG. 2B represents details of the external ballistics in the actual guns, being mainly given for reader's comfort, helping those skilled in the art better understand the ballistics analysis will follow, and clarify the language. The figure shows the aiming sight line 224, previously shown as 207 in FIG. 2A, the gun's muzzle 220 and the bullet's initial aimed direction 221, ignoring the gun's axis drift due to internal ballistics. The FIG. 223 represents the fine movement of the projectile around the theoretical ballistic curve, called "Bullet's trajectory" in FIG. 2B, also caller Euler's curves, for gyroscope precession movement, making bullet have various orientations at the moment it readies the target, and having various in-target trajectories.

Figure 2E:
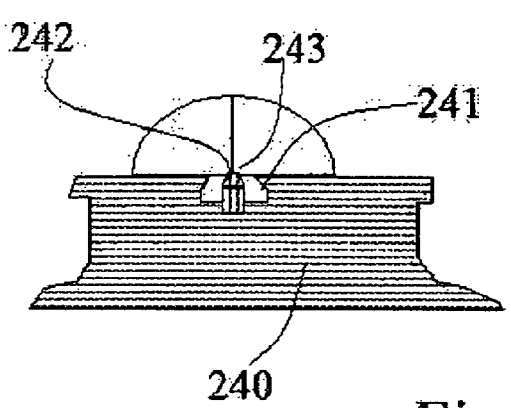
FIG. 2C-2E shows details of the actual handgun aiming devices using various aiming profiles envisioning physical-physiological al effects in shooter's brain
Figure 2D:
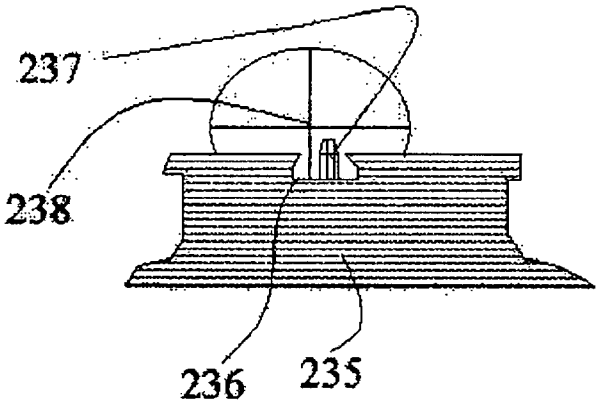
Figure 2C:
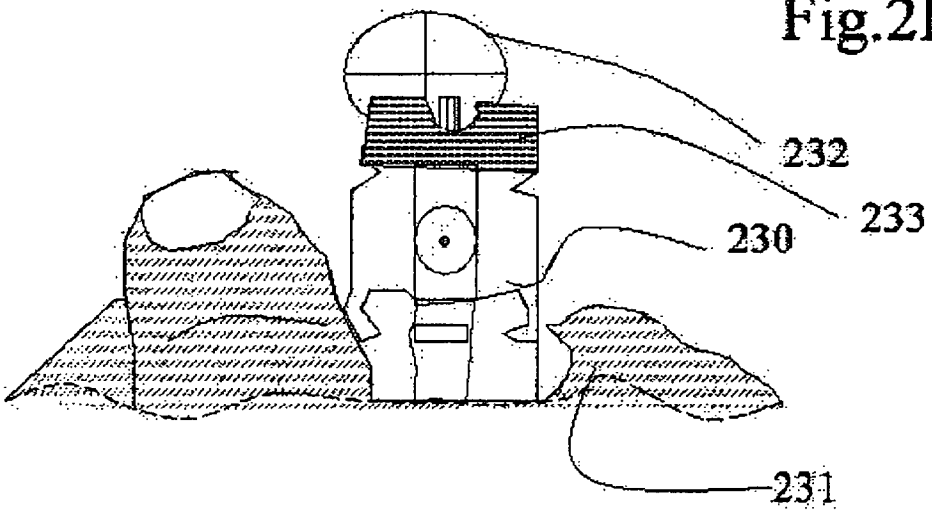
Prior Art Fig.2C

FIG. 2C-2E shows details of the actual handgun aiming devices using various aiming profiles envisioning psychophysiological al effects in shooter's brain. FIG. 2C shows a view of a hand 231 on a handgun 230 ready to fire, but being off the target 232 in the (+; −) quadrant with classical round aiming device 233.

FIG. 2D shows a psychological improved aiming device 235 with trapezoidal shapes the rear sight 236 and the front sight 237 aiming at the target 238, exploiting brain preprogrammed natural abilities that reconstructs virtual straight lines pointing the target. As the patent shows the mind will automatically elongate lines of the sight cuts up to their meeting point, making a more accurate aiming.

The FIG. 2E shows the trapezoidal aiming device 240 pointed on target, with the rear sight 241 and front sight 242 aligned at the base of the middle of the target 243 while the bullet is supposed to hit the target a little bit above the center in the intersection of the trapezoidal lines extensions forming two triangles with a common tip.

Figure 2F:
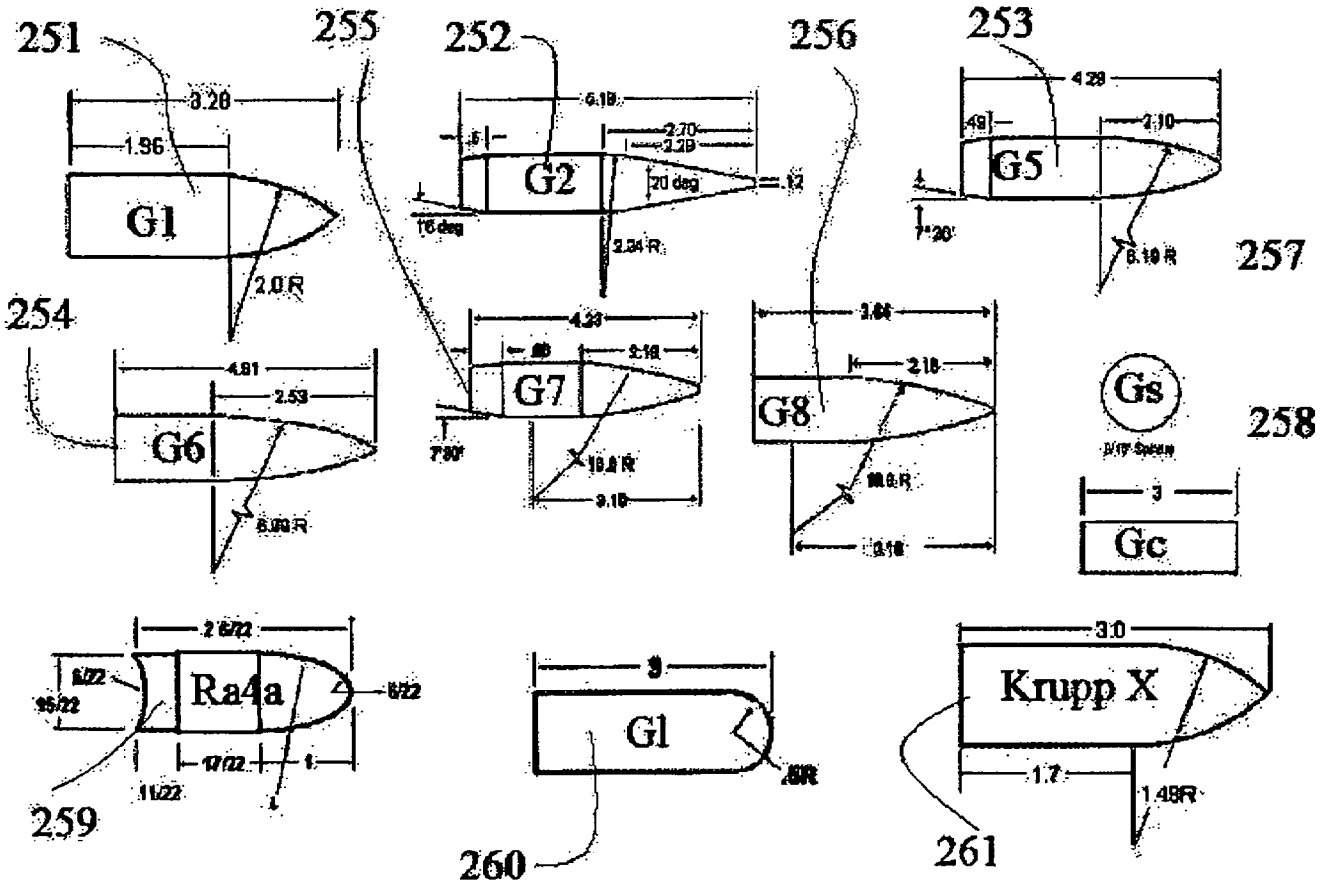
FIG. 2F shows the state of the art in bullets profiles presented for reader's convenience, as being useful in understanding FIG. 3A

FIG. 2F shows the state of the art in bullets profiles presented for reader's convenience, as being useful in understanding FIG. 7, without more details that may be found in literature the following main profiles are listed, as G1 251, G2, 252, G5 253, G6 254, G7 255, G8 256, Gs 257 a basic spherical profile, Ge 258 a basic cylinder profile, a modern profile Ra4a 259, Gl 260, and krupp x profile 261. I considered important for the reader to have them available for understanding easier the FIG. 3A.

Figure 2G:
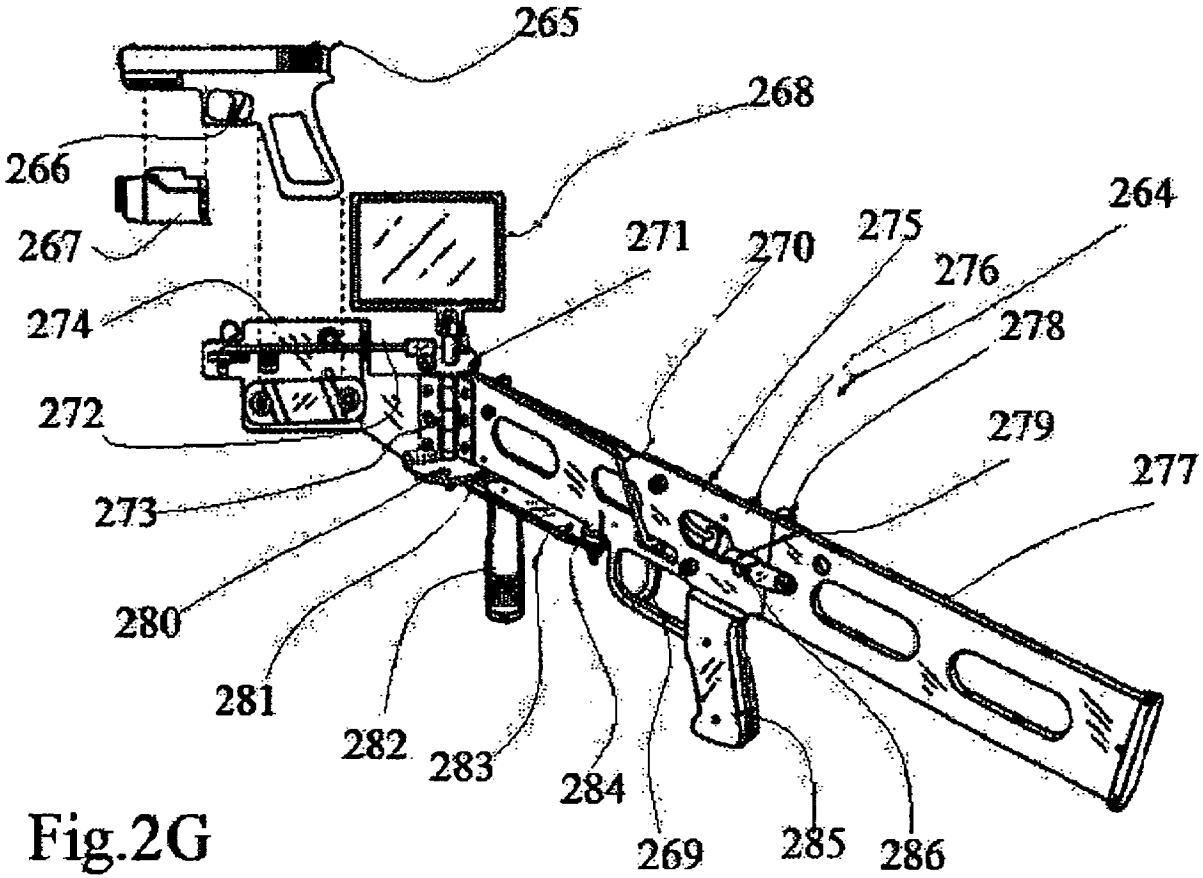
Prior Art Fig.2G
FIG. 2G is presenting an articulated gun support, a simplified version of the "corner shoot" gun device presently used by special forces in street combat

FIG. 2G is presenting an articulated gun support, a simplified version of the "corner shoot" gun device presently used by special forces in street combat, that allow them using the handgun around the corners. The description of each element was given above, in the state of the art therefore I will not repeat it here. This concept improves a little bit the shooter's safety, allowing it to hide behind objects, but has a lot of deficiencies corrected by the present patent.

Figure 3A:
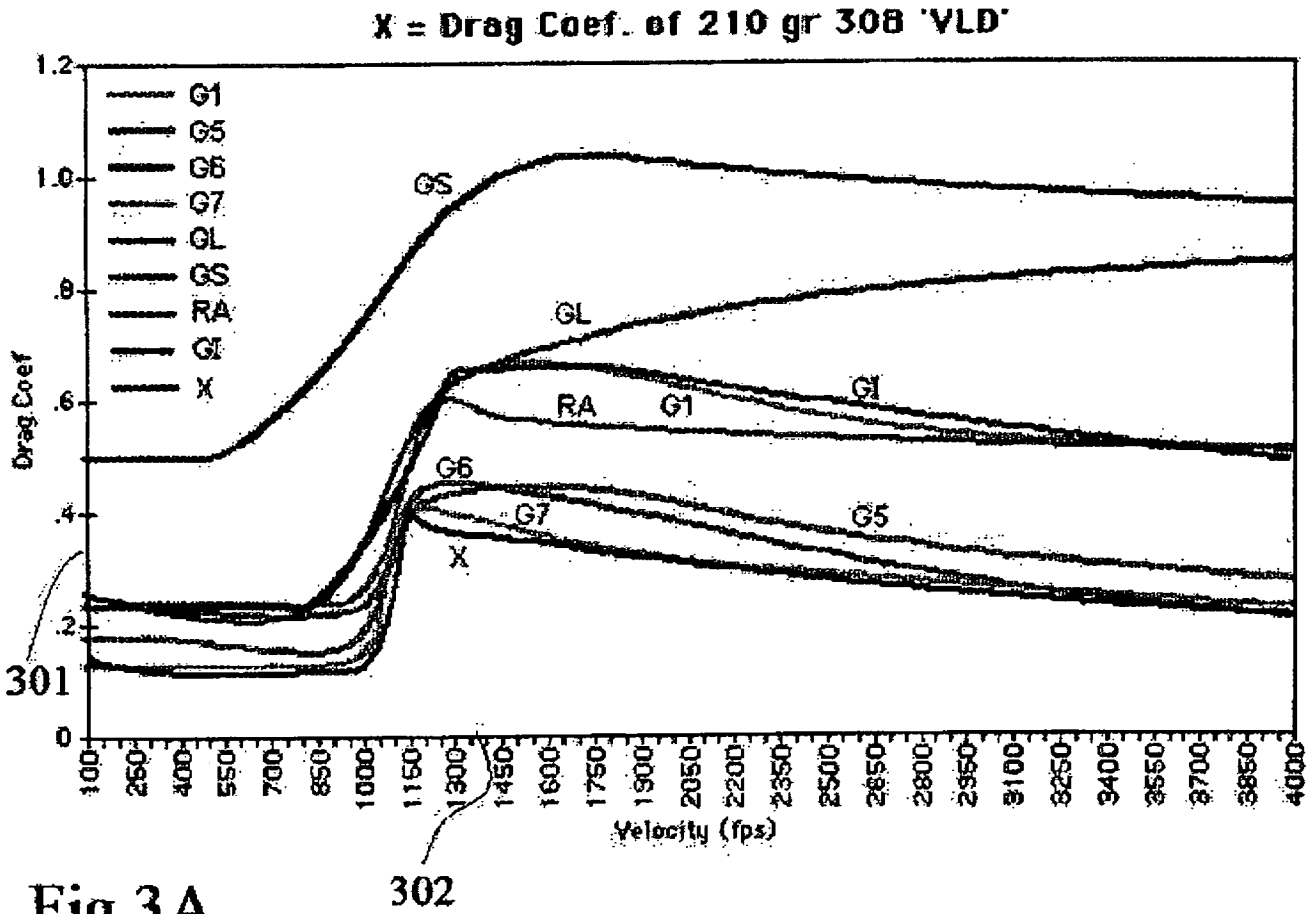
Prior Art Fig.3A
FIG. 3A presents the drag coefficient variation with various profiles shown in FIG. 2F as function of bullet's speed, a fundamental factor in understanding the ballistics.

FIG. 3A presents the drag coefficient variation with various profiles as function of bullet's speed, a fundamental factor in understanding the ballistic correction. It is seem that the (is spherical profile has the biggest drag force.

The force is calculated by using the formula:

$$F_{drag} = \frac{C^{x}_{drag}(v)v^2}{2}\rho(p, T, H)S_x, \tag{6}$$

Where v is the speed $S_x$ is the projectile's cross section perpendicular on speed vector and ρ(P,T,H) is the air density that depends on air pressure that depends on altitude (the barometric formula) and weather, temperature and humidity. It is seen that in transonic domain the drag coefficients are dramatically increasing. These coefficients and experimental data tables are used in calculating the ballistic effect that makes the projectile behave differently in air than in vacuum or water.

Figure 3B:
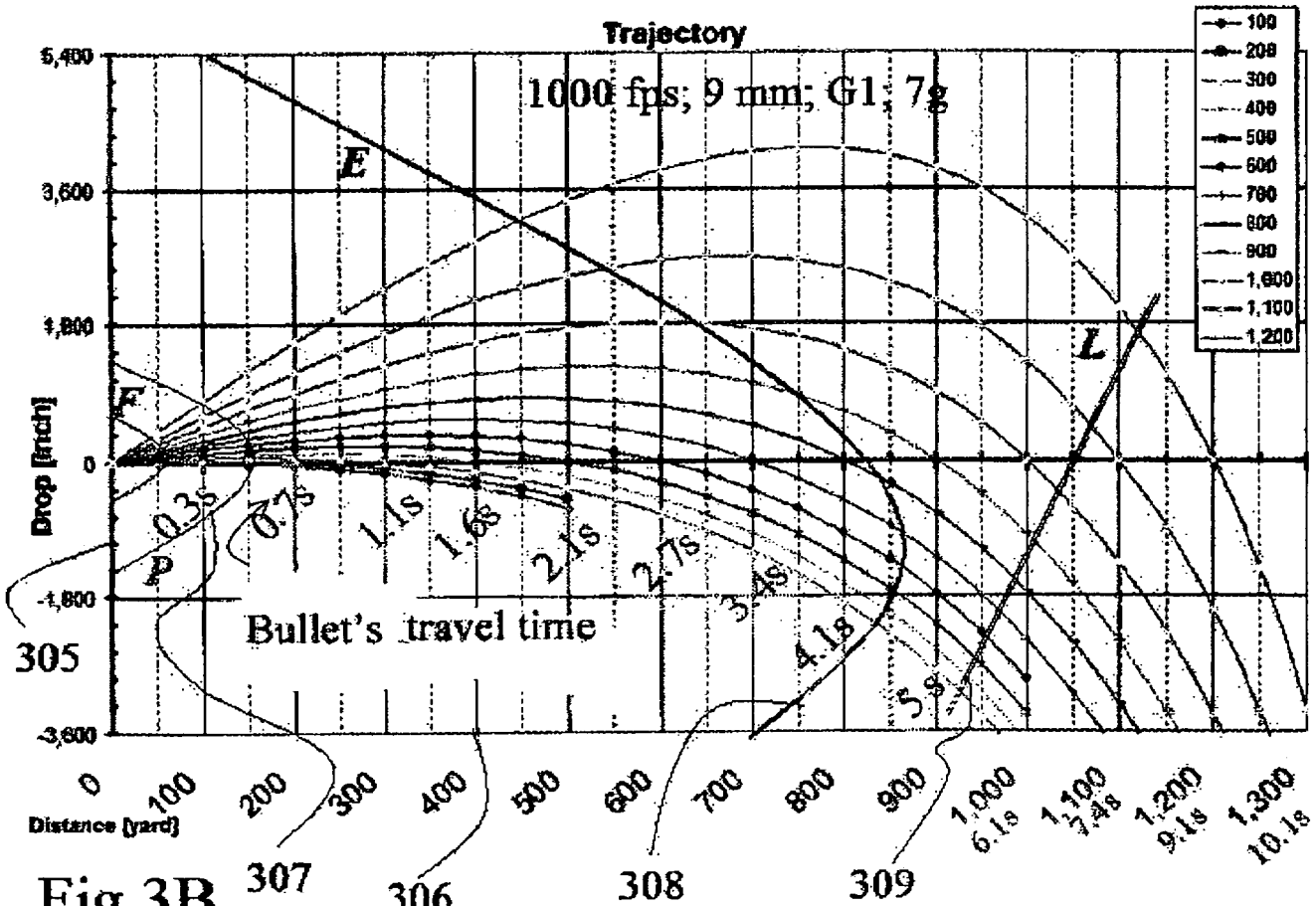
FIG. 3B shows an example of tiring with a medium performance handgun "9 mm Makarov" for aiming at various ranges with no wind, in normal conditions.

FIG. 3B shows an example of firing with a medium performance handgun "9 mm Makarov" for aiming at various ranges 306 with no wind, in normal conditions.

This case was taken because is a relatively cheap weapon, with subsonic ammo, used mainly in short range combat under 50 yards curve F (frequent usage), and in rare eases for distances up to 150 yards the curve P (possible to use) 307. For longer range the borehole axis have to be tilted, and the height or drop 305 of the bullet have to be considered. The firing has a practical limit L 309 where the bullet's energy is reducing up to 10% of the initial energy at the muzzle. The present invention is aiming to extend the usage limits h 308 by about one order of magnitude, making it a practical device to confront rifle armed opponents.

Figure 3C:
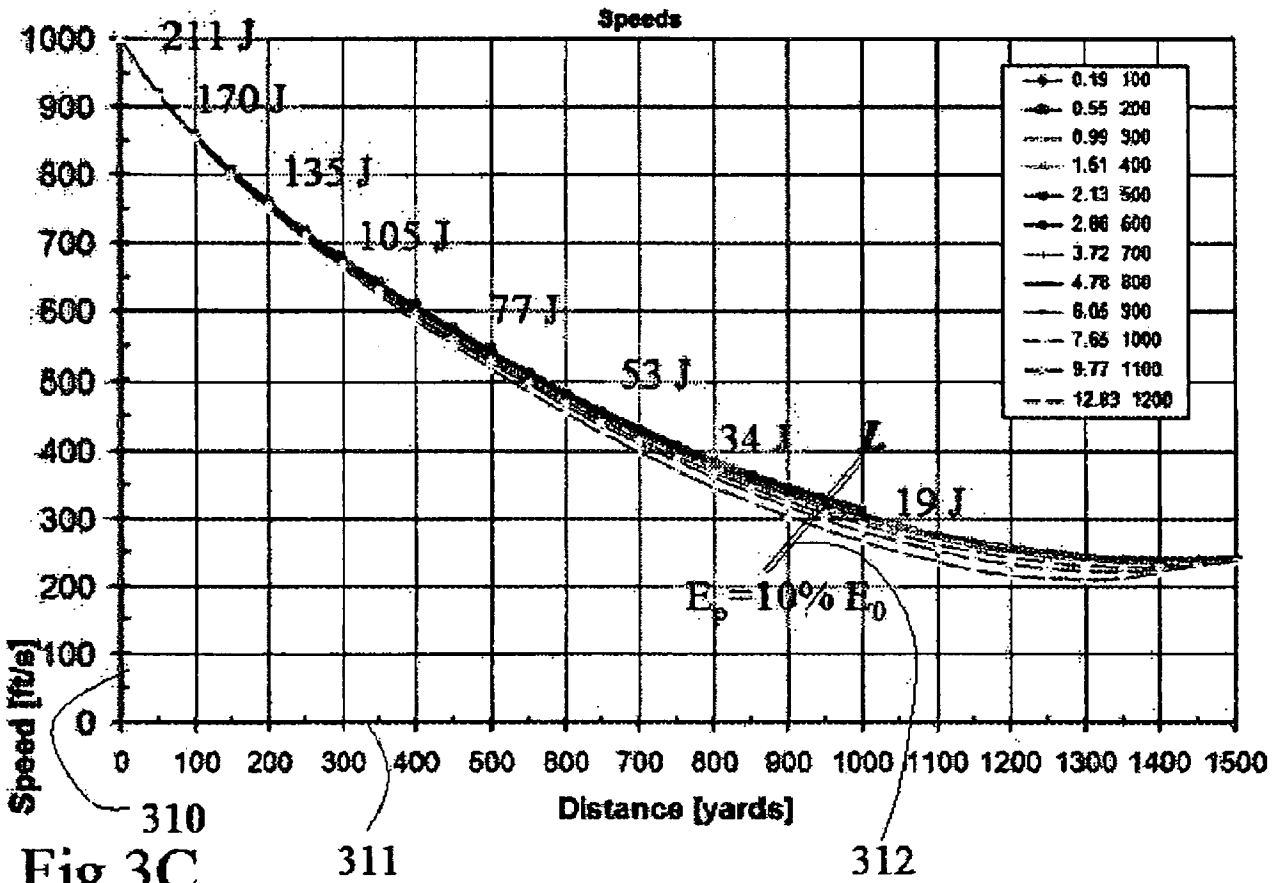
FIG. 3C shows the variation of kinetic energy for a 9 mm Makarov bullet, and the borehole axis tilt for various zero range distances, in order to comprehend the meaning of the initial recoil movements in the gun during internal ballistic phase.

FIG. 3C shows the variation of kinetic energy for a 9 mm Makarov bullet, and the borehole axis tilt for various zero range distances, in order to comprehend the meaning of the initial recoil movements in the gun during internal ballistic phase.

The figure represents the bullet's speed 310 as a function of distance 311, showing the practical application limit L 312 where the bullet's kinetic energy becomes 10% of the initial energy at the muzzle. In the legend nearby the firing angles are given together with firing zero ranges. It is observed that bullets fired at longer distance have faster speed degradation than the bullets aimed at shorter distance because their trajectory is longer.

Figure 4A:
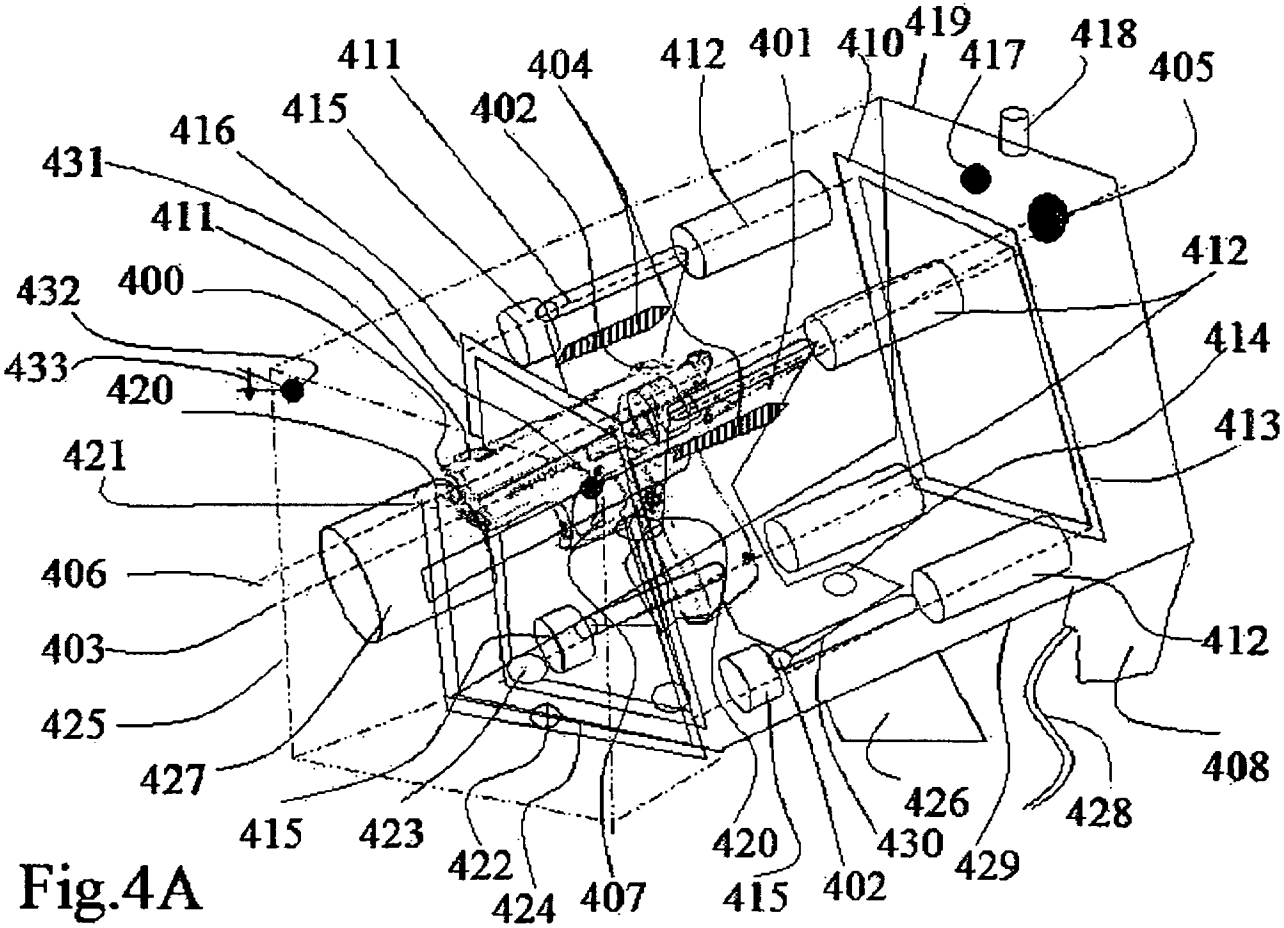
FIG. 4A represents a 3D axonometric view of the gun adaptor device according to the present invention.

FIG. 4A represents a 3D axonometric view of the gun adaptor device according to the present invention. The previous figures shown the state of the art of one of the most studied domains of the last century, and the basic information which consideration led to the actual invention. The centerpiece or the device is the handgun 400, that is mounted in a specific adaptor, generically called rest or gun grip 401, that has the role to hold the handgun grip tight, in a symmetrical structure allowing open the ammo reservoir area for fast loading and the upper side for gun sight 402 and bullet case extraction and collection.

The "X" shaped holder 401 has the rote to set the momentum of inertia of the gun inside the center of the borehole 403 somewhere between the tip of the bullet and the muzzle, in order to produce stabilized recoil geometry. For balancing the effect of variable number of bullets in the loader the device has adjustable position loads 404. The loads are intended to be lighter than the bullets and placed far away near the slide. When the last bullet withdraws towards the gun due to a loading operation, the weights are also coming towards the gun, maintaining the relative position of the center amass inside the gun barrel. For aiming at zero, zero-range it is used a camera 405 using the sight view 406 above the gun, but the image is projected on the camera screen whatever it is located for the shooter's convenience, and not shown in the present drawing. The shooter activates the gun trigger remotely from the handler under the gun assembly 408 that can be located under the device or remotely on an extender telescopic arm or even remote controlled.

The bullet leaves the gun barrel 403 leaving behind the recoil force in the gun 402. Because the center of mass is inside the gun barrel the deflection rotations upwards and laterally previously described are eliminated, and the only force remained is the coaxial recoil of the assembly. The recoil in usual guns has two components, one due to internal ballistics bullet acceleration and the last one due to pressurized gas fringes between flying bullet and muzzle, that act as a pressure acting on a larger surface and visible through the large fire glow around the muzzle, that is few times stronger than the first recoil. In order to minimize this effect too, a special dumper box 410 is added on the muzzle, where the explosive gas flow fringes are guided in a vortex, split and mixed spreading the shock power in many little wavelets and collecting the unburned gunpowder. The gun recoils back with all the holding device 401 on the slides that compresses the dumpers 412 made of a combination of absorbent town inside a gas compression bellows that gradually take out the speed, stopping the gun assembly before reaching the end modular holder 413.

The lower part of the holder contains an accelerometer 414 that measures the bullet's force indirectly detecting any non-uniformity in the bullets' performances. After coining to rest the gun easily returns to the initial position, stopped by the lore slider bumpers 415 that are preventing from colliding into the frontal frame 416.

There are various constructive solutions for these movement absorber system, one is to use a set of pulleys and a linear motor, moving backward in order to hold the center of mass in the same position and converting recoil energy into electricity, acting as generator during recoil and as motor to return the gun in the right position.

The accuracy of aiming is improved by the range finder 417 that may use a prism passive system of image overlapping and matching or an IR laser pulse illuminator, that transmits the distance to target to a firing computer system. Another system easier to achieve and use may be formed by the set of stereoscopic camera 431, 432 with optical zoom-in capability and an angular actuator 433 that is adjusted by the shooter until it gets the best image, and in that moment reads the angular value and may calculate the range.

The range calculation is simple like:

$$r = d \times tg\left(\frac{\pi}{2} - \alpha\right) \qquad \text{(eq. 3)}$$

where d is the separation distance between the two cameras 431 and 432 and α is the tilt angle 433 of the camera 432 from the parallel axes. The error calculations are more complicated depending on the cameras' CCD resolution and view angle; the use of the zoom-in is reducing the angle therefore the angular sensitivity MOA becomes better, narrowing the incertitude in range interval. Due to ballistics intrinsic features at long range the accuracy loss is growing More than linear with the range, therefore the group average dimensions in MOA is growing with range. This system is complementary to active system, based on IR laser pulse, whose relative error is decreasing with the range increase, but has the advantage that is stealth, compared with the active system whose presence may be detected by target's IR monitoring systems.

The measured range together with atmospheric data, N direction and GPS coordinates from a sensor array 418 placed un the rear wall of the outer box 419. The description in how the electronics works in controlling the tire will be described later, at the dedicated figure.

The internal gun-sliding frame is composed from 4 slider rails 411, a rear frame 410 and a front frame 416, The structure can be dismantled and stored in a compact form. On the frontal frame at the level of the gun's muzzle there are installed a pair of electric actuators 420, that may be installed at the gun muzzle level, holding the frame in cantilever requiring an oscillation dumper in the back or in the center of mass position. The actuators are connected on another frame fork shaped 421 by an horizontal turning actuator 422 used to compensate external wind and target movement, while actuators 420 are used to compensate for ballistics, Magnus effect and differences of altitude.

There are basically two notions, embedded when we talk about differences in altitude:

one relative to the average elevation of the battlefield that has as an effect the reduction in air density roughly given by barometric formula and corrected with weather pressure difference, or directly measured by an absolute pressure sensor on gun's box.

Another meaning, that means the difference of height between shooter and the target has direct ballistic formula implications, with respect to the fact that ballistics is mainly studied extensively on horizontal, and any introduction of height difference have to be appropriately calculated. For example imagine that in FIG. 3B the shooter has the target placed at a height of 50 yards above the shooter's level, at a distance on horizontal of 600 yards. On local shooter instruments he will read a range of about 630-680 yards, and a tilt angle versus horizontal of about 4 degrees, but it will use an angle of about 8 degrees corresponding to the zero-range of 1000 yards. These values may be confusing for ordinary shooters, but very clear when put into equations and that is why an automatic tiring system achieves faster, better results, calculating and reaching the aiming angle in fractions of a second. The actuator 422 is connected to a metal frame 434 of the outer box 425 that is used to hold and contain the gun system by the holder 408 and supplementary handler 426.

It was shown that the gas fringes induced recoil is stronger than the internal ballistics induced recoil due to a sudden increase in surface on the exterior of the muzzle, and that is why the propulsion pressure have to be gradually dimmed behind the bullet without giving it the opportunity to be in contact with a larger surface instantly. The device 427 installed on the muzzle, takes the gas and gradually channels through a vortex generator structure towards a collector system that filtrates the gas and together with the cooling gas from the IR signature reducer is pushed somewhere near the ground, behind the shooter, avoiding the creation of thermal plumes. The device used the gas vortex centrifugal force generation to eliminate on the borders the solid particulates as gun powder inside a storage compartment, sending the burn-out gases to a pre-filter installed in the basement of the external box 429 and from there through the pump in the evacuation hose 428.

There are many ways the slide frames may be made, but an economic way is to use two concentric pipes 402 and to weld the gun holder 401 on the outer sliding pipe 430 making a rigid assembly. During the firing the image is transferred to a stereoscopic set of cameras 423 that provide the shooter the battlefield view, where he can zoom in.

The system may use at choice two range finder systems, one called active 417 based on the time of flight of a short laser pulse that illuminates the target, but the target may detect this action using its laser/radar detectors and suddenly change behavior, or a passive system relying on two camera system 431, set apart from 432, that may be used as a stereoscopic system, using the stereoscopic factor calculation to find the target's range, or having a tilting device 433 that indicates how much the camera 432 have to be tilted until obtain the best image of the target from superposition of the two images generated by the two cameras 431 and 432. Systems having multiple band visualization (UV, Vis, IR, Thermal, Radar) may have image superposition as a built-in feature.

Figure 4B:
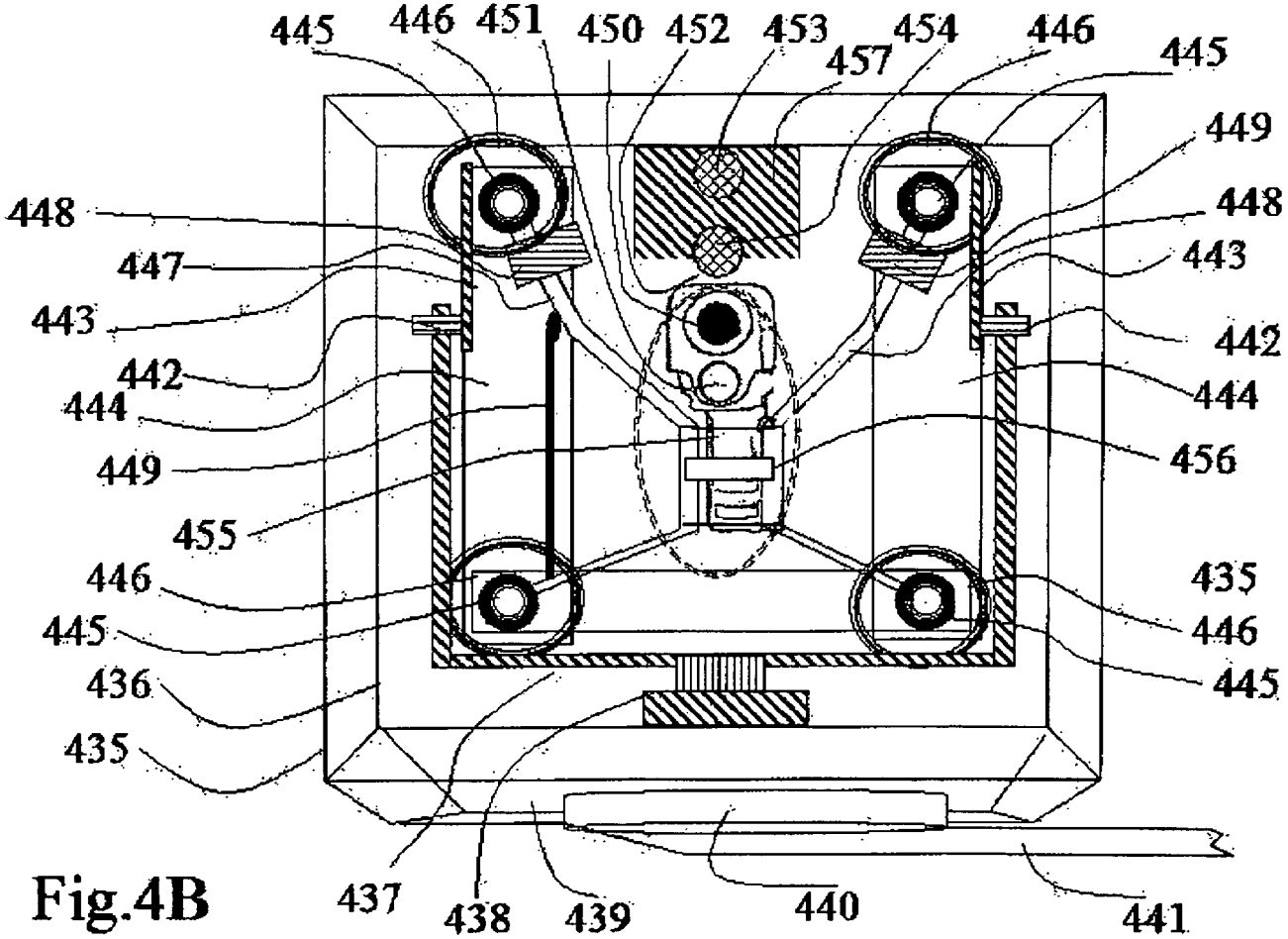
FIG. 4B shows a front section schematic view of the handgun adaptor device of the present invention

FIG. 4B shows a front section schematic view of the handgun adaptor device of the present invention, with the purpose to further clarify the positioning and use of some auxiliary devices. The external box may be rectangular or prismatic having the front 436 smatter than the rear side 435, and having an electronic and utilities compartment underneath 439.

The front side of the box supports the horizontal plane rotation actuator 438 that connects the bottom of the outer box 435 to the fork shaped support 437 allowing a small lateral rotation under 30 degrees, for wind and moving targets trajectory compensation. A larger rotation may be performed from the arm 440 compensator that has 3 freedom degrees and is meant to stabilize the box during shooting compensating for the hand tremor or vibration of shooter's arm and body, or shooter's movement, based on an internal inertial base. The assembly is remotely supported on a telescopic arm 441. The support fork shaped structure 437 is further connected to the inner structure 443 using the rotation actuators 442. At both ends the inner structure has lateral structures 444 that supports the sliders 445 and the recoil dumpers 446. On the sliding rulers there is connected the anus of a gun grip holder 448, that in its upper side has a mobile weight 449 which role is to balance the mass of ammo and gun grip 455. These weights have a variable position chosen such as the center of mass to stay aligned on the borehole axis 450 a little hit in front of the loaded bullet.

The gun holders 448 and 447 are hold tight together around the gun's grip 455 using a set of screws 456, in the gun structure is integrated a laser illuminator 451. On the back of the inner frame 457 are tight mounted the camera 454 that is using the classical gun sights 452 and the rangefinder 453 with IR visualization capabilities. The lateral sides of the outer box 435, 436 has special stealth capabilities being plated with a low IR signature fabric or polymer TFD screen and opposite side camera. Advanced boxes may have up to two cameras on each side and presence or movement detectors in order to provide all directions stereoscopic view to shooter and make him aware of any movement around.

Figure 4C:
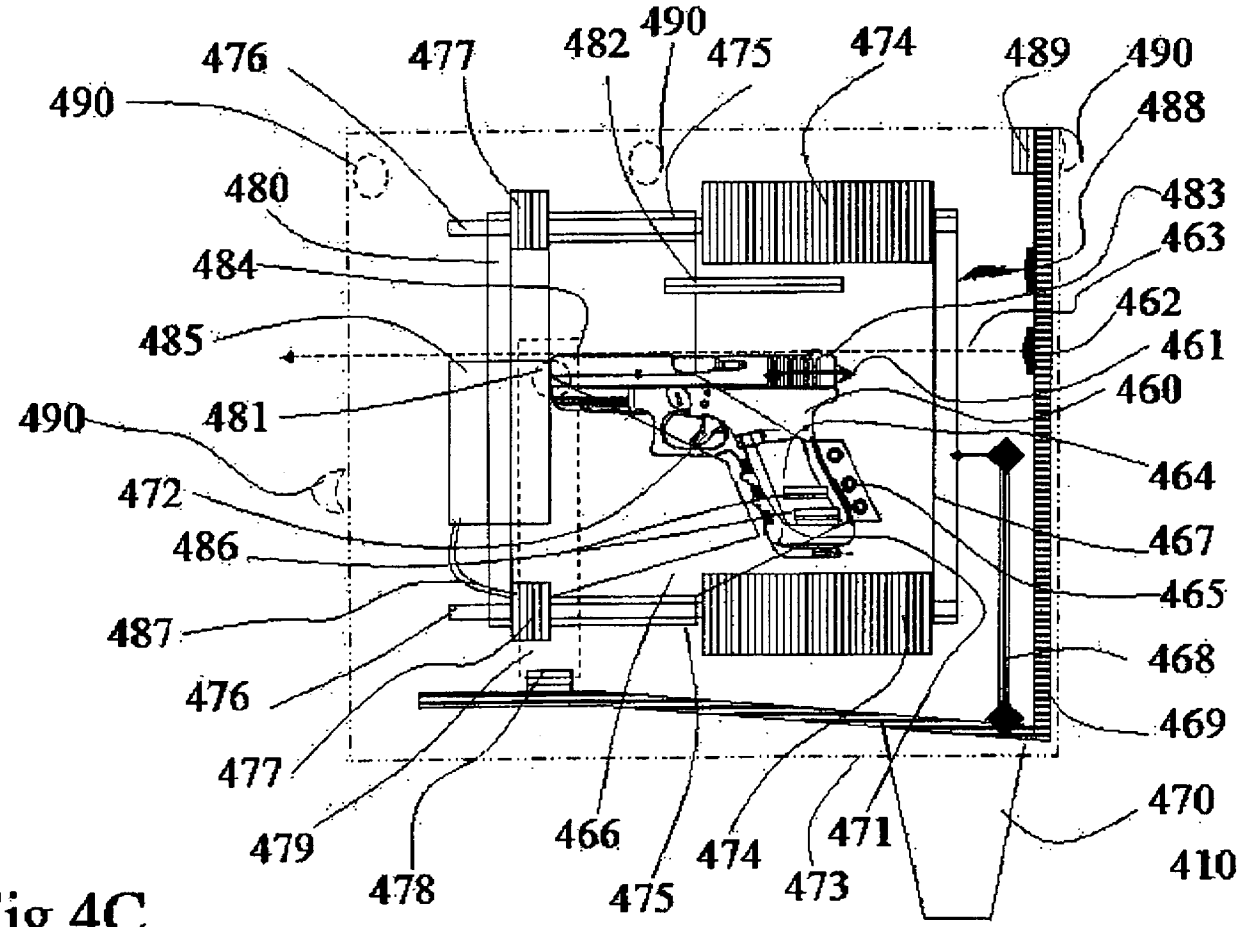
FIG. 4C shows a lateral, schematic view of the present invention

FIG. 4C shows a lateral, schematic view of the present invention in section showing the handgun 460 in the center hold tight from the grip 464 by the profiled grip holder 466 kept tight by screws 465.

The rear side of the inner box 467 is connected to the outer box 469 by an oscillation dumper system that provides the fast attenuation of recoil 461 induced oscillations.

The outer box has a handle that may be hold immediately underneath or remotely by a telescopic extender, having actuators for the safety gunlock and trigger. The outer box 469 may be covered in camouflage materials 473 as fabrics or polymer TFT (transparent field array transistor), or LCD (Liquid crystal display), or E-ink display in order to make it stealth by dynamically copying the patterns and colors of the environment and projecting in the potential target dimension, realizing a quasi-cloaking space inside the box volume. A special attention is given to projected image stabilization, because the eye is more sensitive to movement and variation and contrasts than it is to static scenery, therefore the projectors will work with accelerators in order to maintain the image as steady as possible for far potential observers. The profiled gun holder 466 is rigid mounted on a slide 475 in firm contact with a recoil dumper 474 and end of sliding range bumper 477 being able to slide on the rail 476 mounted between the inner box laterals 480 in front and 467 in the back.

The inner box 480 is hold on a special rotation actuator 478 connected to the fork shaped support 479 that further use the lateral actuators 481. On the gun holder 466 there are the adjustable position weights 482, that have the role to balance the handgun assembly and bring the center of mass in the center of the barrel 461, indifferent the number of cartridges 486 in the loader, and adjusting to their variation. The recoil in this moment applies along the center of mass making the displacement smooth and balanced along the vector 461 with application point in the center of the burning chamber on the base of the tube, dragging the center of mass few inches behind on the same axis.

Another important factor in the recoil is the burned gas fringes escape between the going bullet and the muzzle, that can be reduced by adding a burnout gas collector 485, that applies interferential vortex inside to gradually collect the gases, separate in small sub flows and recombine with a phase difference, and eliminate through a collector pipe 487, into the bumpers 477 made from a bellow structure, and from there being sucked by a fan and sent out via an air filter into atmosphere.

The aiming is done using the camera 462, with a remote placed display, but at hand, using the guns sight mechanism along sight direction 463 through the rear sight 483 and to front sight 484. A supplementary camera 488 has a IR range finder capability and night vision providing the data to the ballistics calculator. A set of sensors 489 is placed above the box measuring the atmospheric data as wind speed and direction, pressure, humidity, temperature ambient light, used also for ballistics calculator. For vision around a set of camera pairs with IR illumination LED and night view capabilities are placed around with the goal to give the shooter equipped with HRTV goggles a comprehensive view all around at demand, or depending on threats detection system indication.

Figure 4E:
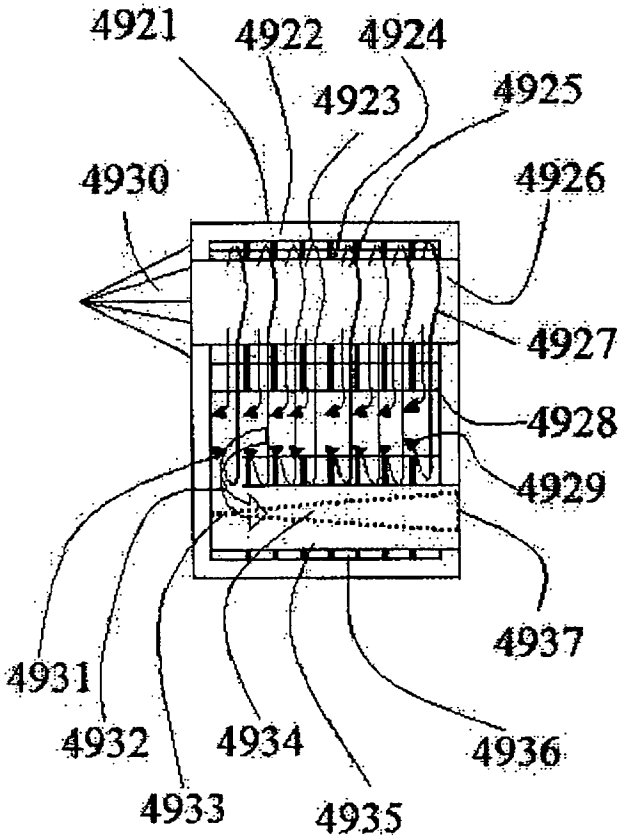
FIG. 4D shows a cross-section, schematic view of the propellant gas collector muzzle recoil reducer an embodiment of the present invention
FIG. 4F, shows a longitudinal section after AA' section line in FIG. 4D, a schematic view of the propellant gas collector muzzle recoil reducer an embodiment of the present invention
FIG. 4G shows a chart with schematic view of the muzzle shock wave decomposition and recombination inside the propellant gas collector muzzle recoil reducer an embodiment of the present invention
Figure 4D:
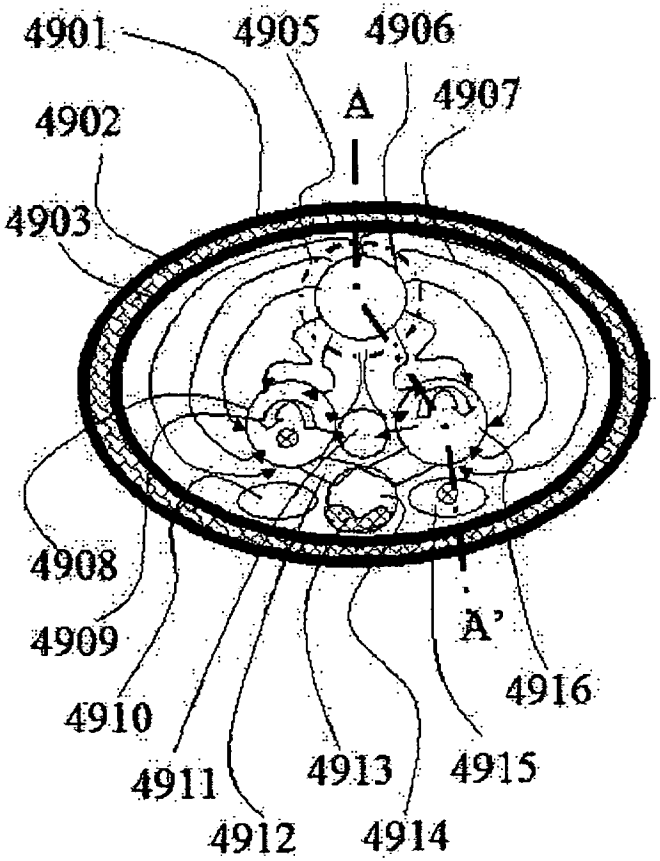

FIG. 4D shows a cross-section, schematic view of the propellant gas collector muzzle recoil reducer an embodiment of the present invention. The goal is to bring the gas pressure behind the bullet at the atmospheric pressure in the moment the bullet is moving out of the gun system, in order to avoid gas volumes caught between bullet and muzzle and discharging force on muzzle, pushing the gun in random directions. Because the pressure shock may reach few hundred bars the device is double cased, having an external case 4901 that is mounted as a continuation of the muzzle, on its thread and contains a thermal and vibration insulation 4902, that covers the inner case 4903. The borehole is continued inside the secondary-recoil dimmer chamber, the bullet tube is made by a set of profiled nozzles 4906 having the inner diameter a little bit bigger than the bullet's site and is part of a cylinder 4905 that has openings in all directions that allows the gas jets 4907 escape equally in all directions, and following inside different paths. They reach two internal tubes 4908 left spinning and 4916 right-spinning entering from a side to create and maintain inner vortexes. The centrifugal motion in the tube separates the particulates and sends them into a collector tube 4914 through the orifices 4912, where it is deposited 4913 and may be extracted opening the lids from the ends. The clean gas is entering into the pressure equalizer tube 4911. Inside the vortex tubes 4908 where the vortex or cyclone 4909 moves leftwards the gas strings 4907 recombines, and travels in series through the tubes splitting the pressure shock into wavelets that successively recombine inside the cyclone tubes, After exiting the cyclone tubes depleted of any solid particulates, they travel through a drift tube 4910 and than in 4915 from where is collected by the gas sampling system and transported away from the shooter.

The system is a combination of Helmholtz resonator with an interferential pressure wave splitter and recombine that makes that fraction of the same initial pulse wave to recombine after gaining various phase shifts or time delays that generated a higher harmonic and a lower harmonic, and in this way the ¼ ms high pressure shock pulse is split in more than 60 sub-waves, or wavelets that are delayed by at least ½ of period and transformed in a composed wave longer than 15 ms, with much smaller amplitude by a factor of 100 (−20 dBA).

FIG. 4E shows a longitudinal section after AA' section line in FIG. 4D, a schematic view of the propellant gas collector muzzle recoil reducer an embodiment of the present invention in order to show the gas-dynamic process taking place along the device. The section line has been drawn such as to include the essential details. The recoil dumping box 4921 has an external cover over its insulation 4922 that is coating the internal box walls 4923. The bullet's path 4826 is a hollow cylinder that at one end is sitting tight over the gun's barrel and at another end is terminated by a stoma-diaphragm device 4930 that is pushed open by the bullet's fore pressure and closes immediately after it, leaving minimum amount of gases leak out. The lateral border of the virtual bullet tube extension 4926 is made of resonant cavities 4924 separated by diaphragm walls 4925 resembling a washer or nozzle, that may be tilted in such a manner to allow uniform gas flow distribution among the stages. The propellant gas leaking in front of the bullet fulfills the cavity from the rear end 4926 up to front-end diaphragm 4930 where it reflects back flowing into the labyrinth passages.

The gases behind the bullet having higher pressure escape gradually alter each stage washer starting to split on sub jet flows 4927 and starting to move in the labyrinth paths 4907 in FIG. 4D. This flow along the paths will make the sub-flows 4927 arrive at different times at the tilted entry in the vortex tube 4928, initiating and maintaining the inner cyclone 4929. This stage operates as a centrifugal separator, making that all particulates to be push radial into an accumulation tube at the bottom, where they deposit, leaving the gas clean of solid particulates and heavy aerosols resulted from partial gunpowder burning with partial condensation during expansion. At the end of the vortex, a special channel 4931 is made that takes the flow 4932 in the next drift tube 4933. This tube transforms the vortex movement on the exterior 4935 into a laminar flow in the center 4934 using a conic diffusion mesh 4933 in the center of the tube and making the gas leave smoothly through the end of the tube 4937 into the exhaust tube. The lateral surfaces exhibit cavities acting as a Helmholtz resonator 4936 eliminating the high frequency pulsations.

Figure 4G:
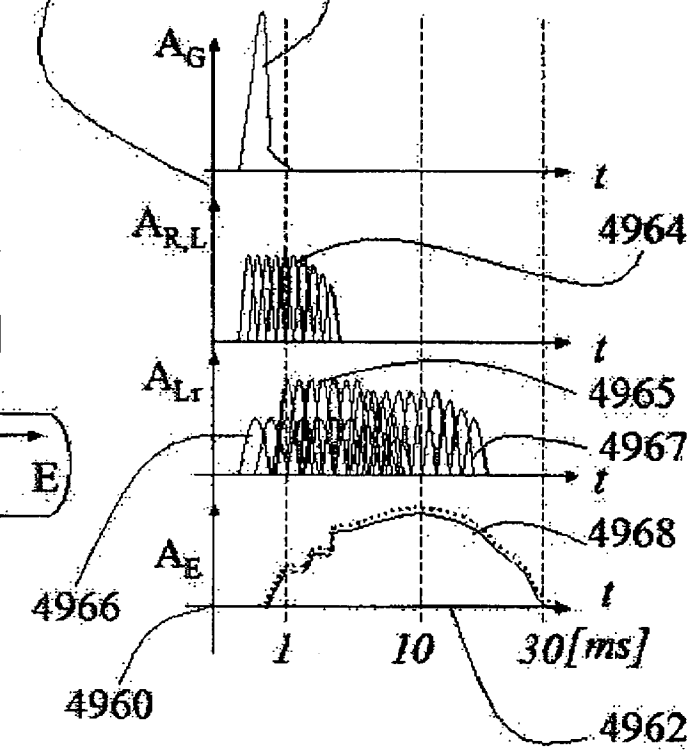
Figure 4F:
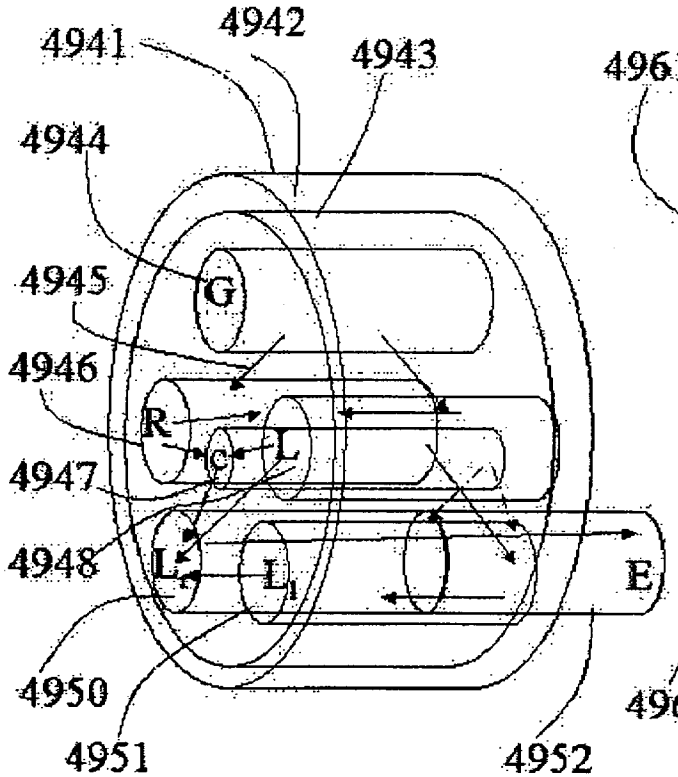

FIG. 4F shows a schematic view section, of the propellant gas collector muzzle recoil reducer gas flow pattern an embodiment of the present invention where the main tube architecture and flow sense is presented, in order to get a better understanding on how the process of gas spike splitting in a plurality of sub-flows delayed differently, and gradually recombined into a unique quasi-laminar flow works.

The box case 4941 is covering the insulation 4942 that coats the inner box 4943. Inside the box there are several tubes, as gun tube "G" 4944 where the bullet travels out, acting as a stopper in front of the propellant gases that are forced to go laterally 4945 splitting in many sub-flows and after a path like a labyrinth that introduces variable delays to different sub-flows. After passing through the labyrinth the two main gas streams 4945 and its homologous, are reaching the left "L" 4948 and right "R" 4946 where they create the vortex that creates a cyclone filter that separates the particles from gas and make them accumulate in a bottom tube, not shown in the picture because there is no gas flow. The central tube "c" 4947 is in communication with both left 4948 and right 4946 tubes and is used as pressure equalizer, or a shortcut, sending the extra pressure in the exhaust drift tubes lower right "$L_r$" 4950 and low-left "$L_l$" 4951 from where is pushed in the exhaust tube "E" 4952 as a quasi-laminar flow.

FIG. 4G shows a chart with schematic view of the muzzle shock wave decomposition and recombination inside the propellant gas collector muzzle recoil reducer an embodiment of the present invention in order to understand how the muzzle recoil is eliminated, simultaneously with a drastic noise, flare and pollution reductions.

The chart 4960 shows the time in milliseconds on abscises 4962 in a relative non-uniform quasi-logarithmic scale shoving on the ordinate 4961, four overlapped and shined charts representing the amplitude variation of the pressure wavelet in the tube segment.

The initial pressure spike as is perceived in the gun's tube "G" and noted as "$A_G$", meaning the amplitude of the pressure in the Gun tube, is a spike with the duration under 1 ms, typically ¼ of a ms that is cut in slices delayed with different times in the labyrinth and recombining in the vortex tubes "R" and "L" giving about same pressure variation "$A_{R,L}$" as those shown in the interference curve 4964 where all the wavelets are represented, with their delay and the final wave being an integral over all wavelets present there at a certain moment of time and specific location in the tube. Forward one wave steps directly in the drift tube, while the other goes first through LR tube that introduces another delay and so in the lower right tube prior to exit the wavelets composition looks like that in "$A_{Lr}$" where the "L" vortex wavelets 4965 overlap the "c" wavelets 4966 that has a longer train of waves because takes gas all the time based on pressure difference, and combines with "R" wavelets 4967 delayed even more, due to the fact that they had to travel along all the drift tubes.

Their summation in the exit "E" gives the new shape of the pressure spike 4963 after passing through the box and becoming the wave 4968 composed of a low frequency, smaller amplitude component that carries a high frequency component of even smaller amplitude, making the noise be even milder than a champagne cork opening noise, and no extra recoil in the muzzle due to propellant gas fringes. The system was designed to eliminate the supplementary recoil of the gun given by the escaped gas fringes and pressure shortly acting on the muzzle's surface, but collaterally it also eliminates the sound waves, and the particulates from the burned gas, making it less toxic for the shouter. With this device all the recoil is that due to internal ballistics acting along the gun's barrel direction, with all other shock components suppressed, allowing a comfortable seamless operation of the gun in the battlefield.

Figure 5A:
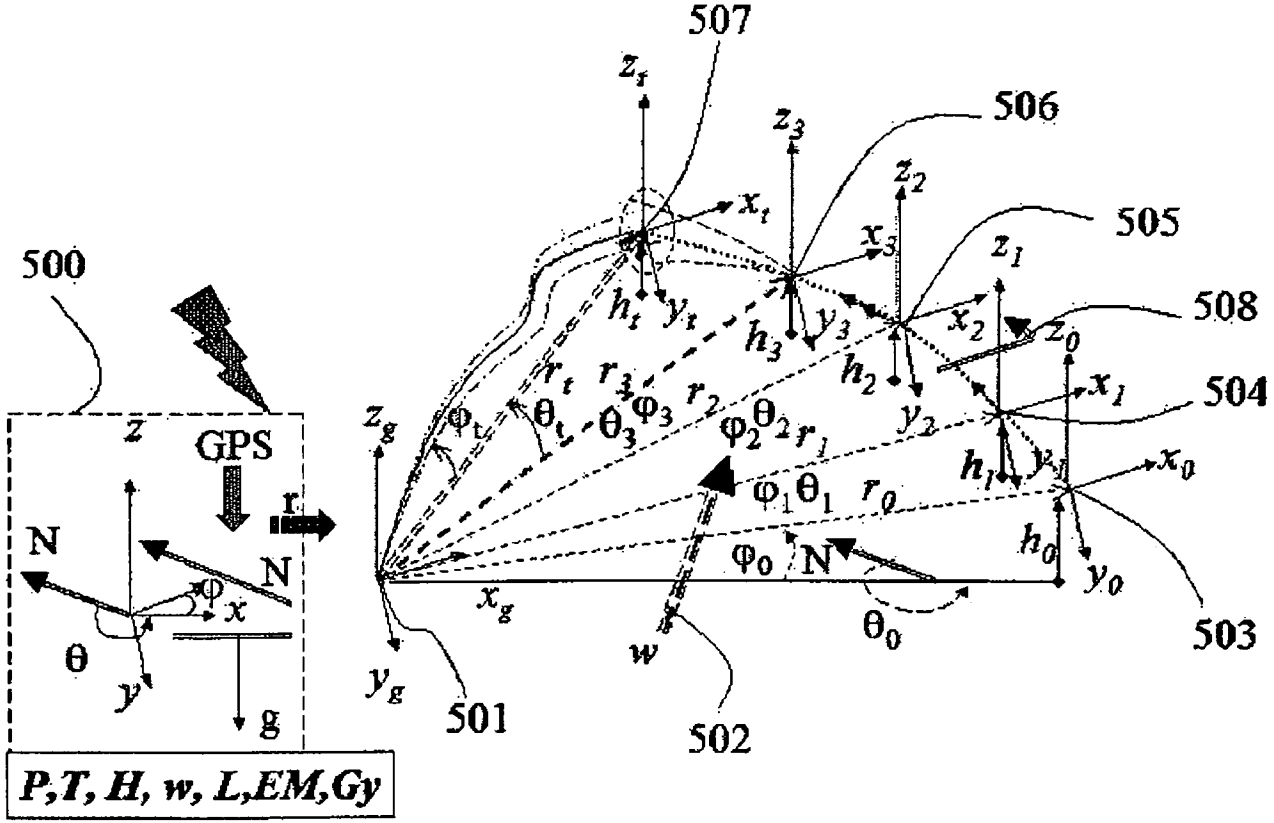
FIG. 5A shows a diagram of the accurate firing method applied for mobile targets according to the present invention with all corrections

FIG. 5A shows a diagram of the accurate firing method applied for mobile targets according to the present invention with all corrections.

The system 500 represents the firing unit electronic data acquisition and communication system, placed on the bottom of the exterior box, with sensors spread around the box.

The system contains an electric compass pointing N and showing the divergence from north and a set of accelerometers to detect the movement and to find the vertical position. In rest, the system will deliver accurate indications of the azimuth angle and elevation angle, further stabilized in the inertial base containing a gyroscope Gy. The gyroscope and accelerometers will define accurately the shooter's movements. Based on these indications we may accurately know the angles 0, the azimuthally angle that shows the direction of the gun's axis relative to north direction, and the elevation angle $\phi$ showing the tilt of the gun axis in the rest position aligned with the sight, relative to the vertical direction or horizontal plane of the place.

The gyroscope inertial base will maintain these directions after initialization no matter how the shooter will move in the field. We may note by (0,0,0, $t_{ini}$) the coordinates of the shooter, when does the initialization of the firing box, and relative to that he will have the coordinates ($x_g$, $y_g$, $z_g$, $t_g$, $\theta_g$, $\theta_g$) 501, or may have a GPS unit to transform these coordinates in universal coordinates relative to earth's system. For simplicity the FIG. 5 represents a shooter in a static position, most frequently encountered in standoffs, but the firing computer is able to mitigate dynamic positions.

The electronics box also measures the absolute pressure, an indirect indication of the place's altitude via barometric formula, "P" 500 table, the environment temperature, "T", local humidity "H" or rain state and rain intensity. Shooting through rain is a major perturbation to firing and hitting probability is decreased depending on rain's intensity, because after colliding with water droplets the bullet's direction and kinetic energy is hard to predict, therefore several rounds have to be fired instead accurately. Based on weather station rain droplets and size density indication the computer will predict the probability of success and number of rounds needed to achieve the desired probability. Sand and dust storms require another type of corrections for the atmosphere's turbidity, that may be programmed but the actual state requires a measurement. The illumination sensor "L" may measure relatively air's turbidity and the top of the box may be used to measure rain intensity, but there are very few cases on fights in these circumstances.

A very important parameter for ballistic correction is the wind 502 speed and direction, measured by a directional anemometric sensor on the gun unit 500. The EM field is an important indicator for shooter's safety warning him if it is illuminated by enemy targeting devices (as radar or IR detection) or of the presence of an enemy with radio-communication capabilities on.

The computerized shooting procedure works like this:

The shooter after performing the initialization of his shooting box, is aiming the target, in initial position 503 at a time $t_0$, and gets a range $r_0$ from his active (laser pulse TOF (time of flight)) or passive (prism device) obtaining on computer his and target's coordinates, and calculated the altitude difference $h_0$, ballistics and the shooting angles and may perform an initial shooting, if shooter considers that the target is static. If target is moving, the shooter, instead pressing shot button, presses aim button and the box did not fire but gets the target's coordinates into computer, at a later time, but not too late, shooter aims again, finds the target in position 504 and decides what button to press aim or shoot.

If shooter presses the button "shoot" (or if the button have a double action "aim" ½ and shoot the other "half") the computer calculates the accurate time for bullet to travel from the shooter location to target, than predicts where the shooter coordinates and target's coordinates will be after that time, to which it adds the latency time of the system (time to adjust in the right position and fire) recalculates for this new time and positions in the future and triggers the fire at the right time and right angle. To assure the firing accuracy the electronic inertial stabilizer comes into play disconnecting the box from the handler and compensating all its movements like shooter hand or local vibrations, until the firing is accomplished. The computer calculates the probabilities of hitting the target, and if the weather is hard, an unexpected cartridge dispersion occurred, measured on accelerometers from recoil analysis it automatically may apply a double, triple or n-tap procedure, assuring that the target's action is denied.

This is a sensitive issue; different from the actual special forces doctrine dominated by shoot to kill idea, based on safety or different politico-economic optimization, and was under debate from very long tune ago. The very high accuracy of the system will make the shooter decide if intends to do shoot to kill or shoot to deny avoiding hitting target's vitals.

If the shooter considers that the target's movement is more complex while the target is in position 1, 504, presses the button "aim" and the speed data is accumulated, together with the rest of data.

After a while the target reaches position 2, shooter aims again, and obtains the acceleration data, having now a second degree movement equation thr itself and target, as well as wind and other measured parameters.

Target reaches position 3 506, and the computer accumulates the variation of acceleration data having a $3^{rd}$ degree movement equations. The shooter may go forward tracking the target, or at any moment pressing shot button.

When the shoot button is pressed, based on data gathered the computer calculates the right time to trigger the gun to make the connections between the position at the shooter at the triggering time and the position of the target at the bullet's arrival time; making all the corrections for which there is reliable measured data. In fact the computer will calculate volumes of hitting probability, and will decide how many rounds to fire to assure the preset hitting probability for action denial or kill decision. The battle scene may be visualized in coordinates and shared via communication system. The multitude of the images of the battlefield the shooter have to monitor simultaneously may require 2-3 extra people assisting the shooter with tactical and safety information, overmonitoring all shooters instrumentation in the field.

Figure 5B:
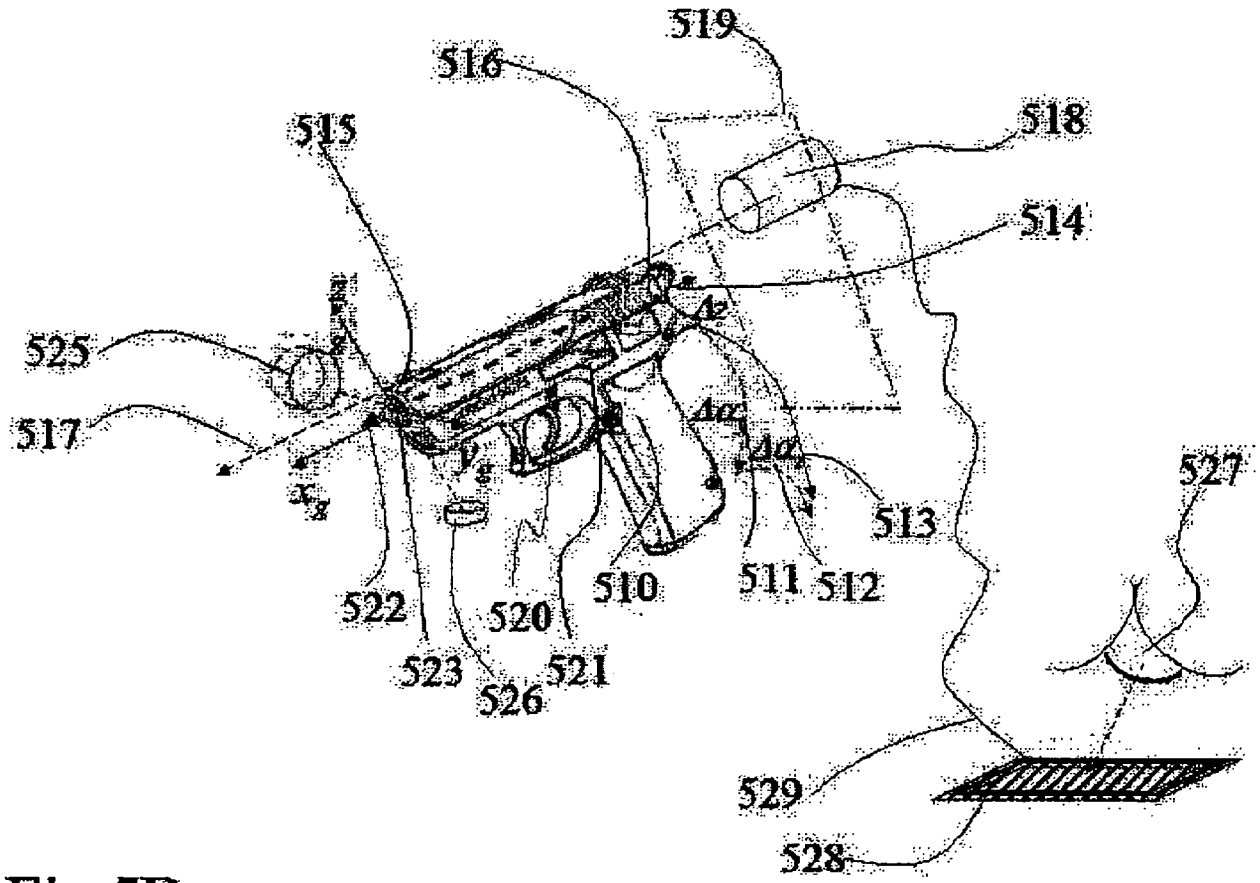
FIG. 5B is a schematic view or the new aiming method and gunner view according to present invention

FIG. 5B is a schematic view of the new aiming method and gunner view according to present invention. The gun 510 is presented without the adaptor support, that suppresses the recoil rotation on vertical 511 and horizontal 512 with a resultant movement 513 so distributive for high accuracy shooting, remaining with a coaxial recoil 514 only because we intend to take a detailed look at aiming system. This system uses classical gun's aiming system made of foresight aiming nail 515 and rear sight 516 establishing the zero sight line 517. The observer's eye have been replaced with a camera, with zoom in capability, placed on the external box 519 and the image is transmitted to a remote display 528 via a cable 529 or wireless connection, allowing the shooter's eye to stay out of the hazardous zone.

The center of coordinates of the gun system is in the center of the bore in the muzzle 523, on the same axes with the bullet, 522, but inside the bullet's propellant gas collection box, not shown in the picture. The adjustments of the bullet's trajectory for ballistics and wind compensation are made from the vertical actuator 525 and horizontal actuator 526.

Figure 5C:
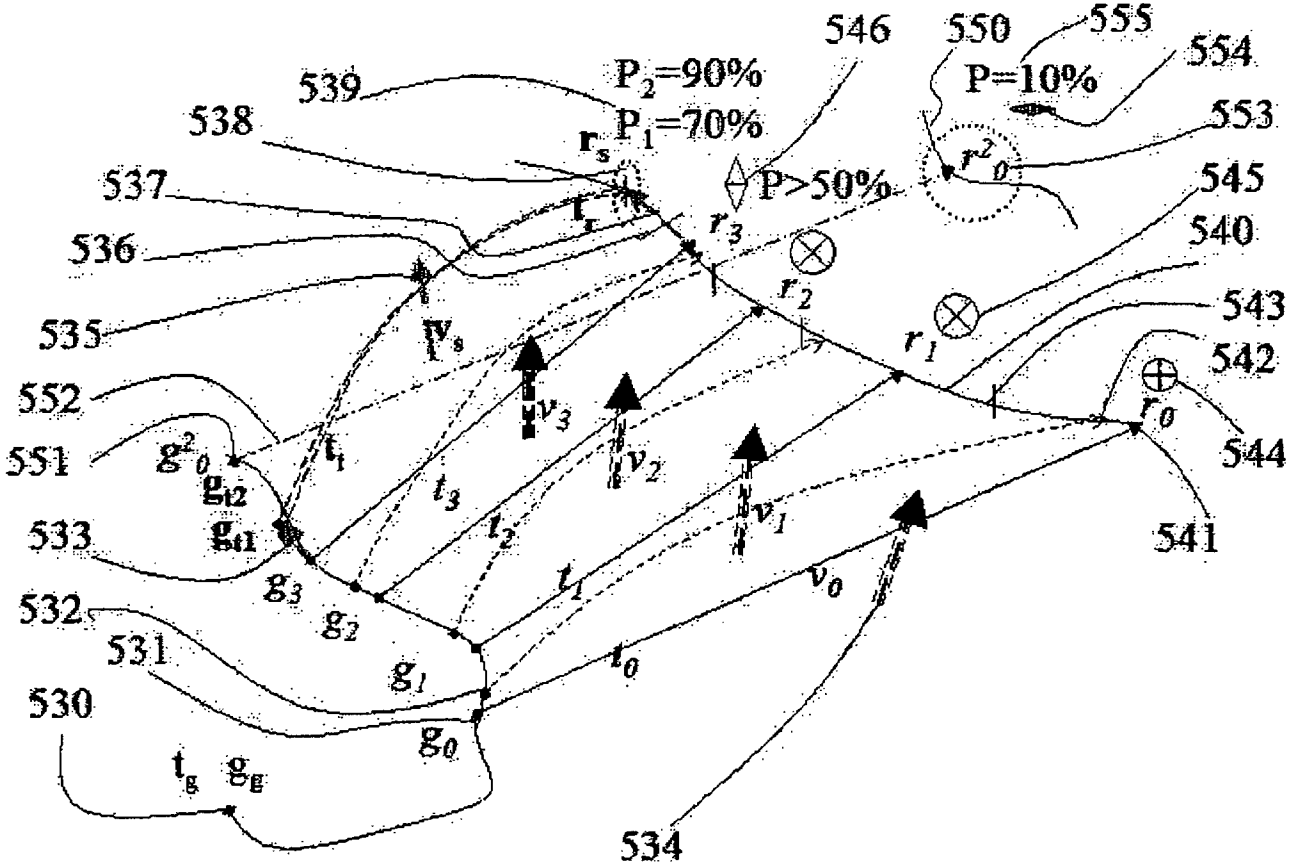
FIG. 5C shows a diagram of the accurate firing method applied for mobile targets and mobile shooter according to the present invention.

FIG. 5C shows a further detail of a more generalized firing scheme where the wind, shooter position and target position are variable during the shooting process, showing the capabilities a system like Nintendo DS or a tablet or cell-phone might have if appropriately interfaced with the sensors and controls.

The figure shows a more complex system, being equipped with gyroscope and accelerometers inertial base, that becomes active when the shooter enters in the battlefield in the coordinates point 530, where he initializes the time base and the gyroscope coordinates and starts gathering weather data. It is possible to be connected at a remote system, via satellite communication, to receive OPS and geo-maps information as well local weather data, or it may be seamless and use only local passive sensors. In this is the case the use of lidar devices or Doppler radars, or IR range finders to obtain details about wind direction and distribution, target movement will be prohibited, and it will use only local passive measurements, as primary data to introduce in a firing control system. In this case the shooter will be deployed in the terrain in a safe location, will approach the battlefield and when it will be near to action, will slop in a safe place and initialize this firing control system 530, where the tg (gun time) is activated/started, and the initial coordinated $g_g$ are set. It does not matter too much if they are transformed in GPS coordinates or remain local coordinates of the scene. From here the shooter moves on a path, in a place he can see the target g0 where he aims the target using the gunsight and range tinder and measures the wind direction and speed, relative to aiming direction. Instantly the firing system calculates the ballistics and the nearest time ready to correctly fire, but upon the shooter option it may or may not trigger the bullet. Because the information on target Is reduced at this moment it displays to shooter that the target is reachable and the probability of successful hit, based on instrumentation inaccuracy only. And sets a blue cross in the image.

The shooter is smart and does not fire, but continues moving on his path and in a new position $g_1$ aims again. The system back calculates and sees if with previous information shooting was a success or failure, introducing into play the average speed it just acquired and it learns that shooting from nearest position possible to g0 531 that is 532 because during system adjustment the shooter moved, into the target considered static in r0 541 may result in a hit in point 542, due to wind change, but based on the average speed of the target that in the time needed for shooting adjustments and bullet's travel time the target reaches the position 543 and the hit was a failure. This result is displayed to shooter after position g1 and target was in r1 with a diagonal cross, which means more data is required in order to have a successful hit. At t2 the shooter aims and get the wind parameters and target's position in r2, calculates again based on the previous data, but now containing the average speed known in point r1 and the new average speed and acceleration just acquired, and makes the difference to see if the potential shooting was a success or failure. The result for non-uniform displacement was—failure—tilted orange cross therefore the shooter aims again at t3 with the gun position g3, with target in position t3 and wind v3 calculates and realizes that the new corrections resulted from the measurement modifies little the firing accuracy, and displays a green diamond showing that the successful hit probability is over the preset value, say 50%, 546 and recommends firing, that is initiated immediately the system is ready at gt1 533 and during the execution measurements it results that the probability of successful hitting is too low 539, say 70% due to a wind 535 change or bullet's dispersion 538 measured on recoil accelerometer the shooting system triggers a "double tap" shooting again in gt2 on the same target and hit probabilities are displayed over the target 537, while in the gun vision system the shooter aims again and visualizes the result, in order to produce an execution quality assurance. In the triggering moment 533 the target was in 536 position, and it moved during the bullets time of flight in the shooting range position 537.

The scene is ended, and the shooter now in g20 551 identifies another target 553 moving on a path 550 and aims, getting the range 552 and wind but because the target being too far an horizontal dashed red line is shown, indicating that the hit probability is too low and with the available ammo left in the magazine is impossible to reach an acceptable successful target hitting probability even in a multiple tap shooting out the entire magazine, and another approach is recommended. In the actual practical conditions about 15-20 bullets are needed to assure a 90% successful hitting. Only automated balanced-systems may deliver such a "20-tap" shooting, and very few brands of handguns if equipped with accessories according this invention may be able to do this due to limited ammo magazine.

Figure 6A:
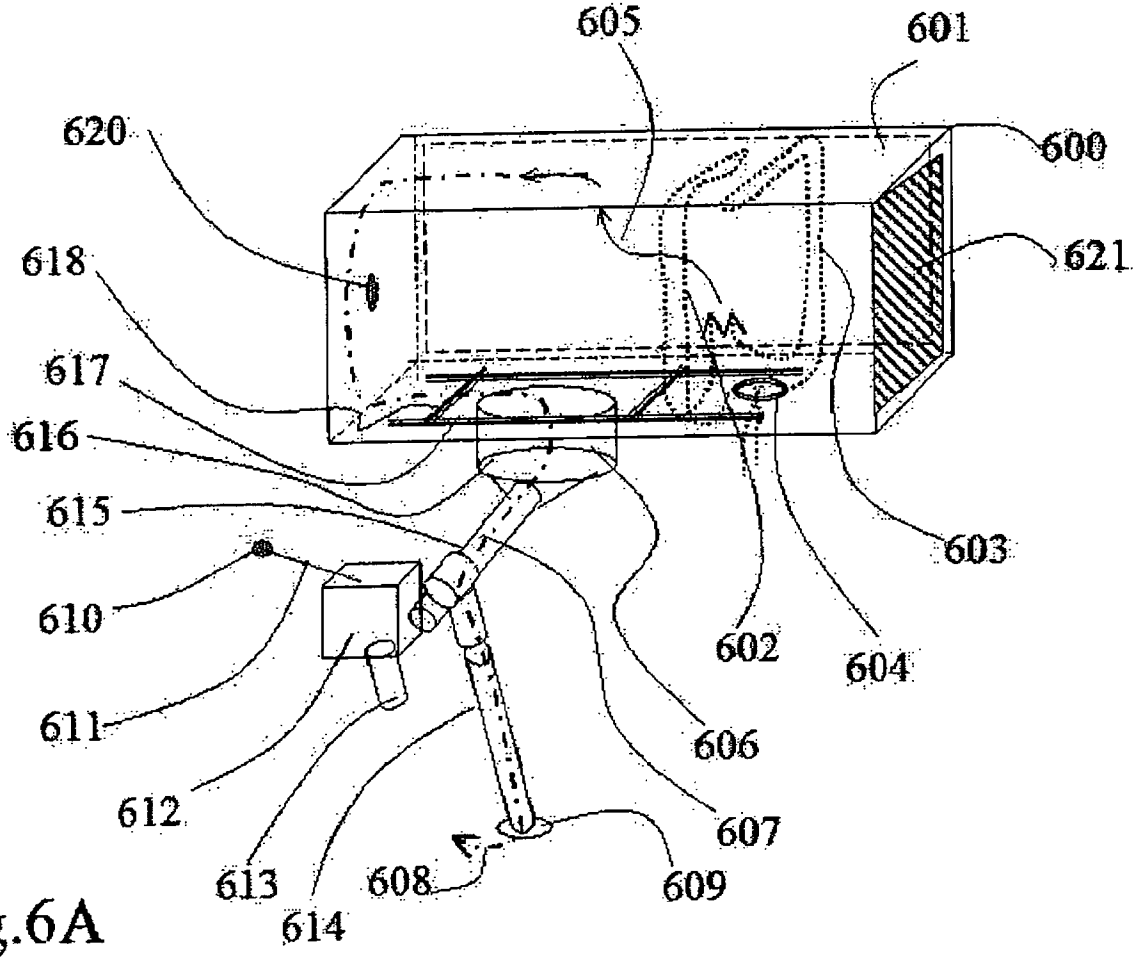
FIG. 6A shows another embodiment of the present invention with respect to stealth function and elongated ants with shoulder or ground rest.

FIG. 6A shows another embodiment of the present invention with respect to stealth system and elongated arm with shoulder or ground rest. This facility is needed in standoff situations against a well-equipped enemy or terrorist group, when the presence of the shooting devices has to be stealth and integrated in environment.

For these circumstances the external box has the capability to be covered in stealth active and passive camouflage materials.

There are several aspects envisioned with respect to the reducing the shooter fingerprint in environment with respect to optic and IR visualization systems as well with, noise, vibration and gas detection.

The outer box frame 600 may be covered with anti-reflective material and low IR emmitance and medium reflectivity 601. This material is brought at the environment temperature by a system sucking air from underneath the box through a filter 604 and circulating it along the surfaces of the box 602, 603, than bringing down in the center 605 and cooling the gun, and aspirating it in a sticking system, that further passes through a filter and pump 606 it along a hose 607 running along the telescopic support to discharge it somewhere in the environment 608 minimizing its fingerprint. The gases resulted from firing will also be collected, filtered and discharged by this system that may have an extra fan 609 making a local wind and mixing better these gases with environment atmosphere making the objects les visible in thermal imaging systems. For visible spectrum and night vision camouflage a TFT display with controllable backlight intensity will be used in order to project the image behind the box in direct view on the screens as the box to look transparent to a far viewer, making a cloak for the gun system.

The camera 610 is placed on a telescopic arm connected to the remote holder 612 that has a grip with controls 613 and takes the image behind the shooter and makes its projection on the opposite screen 601. The same is doing the camera 620 that via stealth imaging computer projects it on the screen 621, that moves out and folds down in order to allow the fire. The entire shooting box system is supported on a telescopic arm 614, with a shoulder rest 612 or ground rest 614 in order to increase its stability in various positions it might be used. At any length, from hand support to long arm during aiming there are natural oscillations that are a little bit reduced using snipers technique of exhaling and holding until the bullet leaves the barrel, but this delays the fire, and the box has a gyroscope mounted inside acting on a vertical, bi-rotational 615, and x 616, y 617 actuators mounted in the box connection 606, that are usually blocked tight during aiming and is released after the shoot button was triggered in order to allow the shooting coordinates be maintains and make the target fine adjustment easier and faster. A procedure might be to compensate the movements by a balanced assembly and coordinate the center of mass and inertia or various moving parts, in order to produce the minimum disturbance in the assembly.

Figures 6B, 6C, 6D:
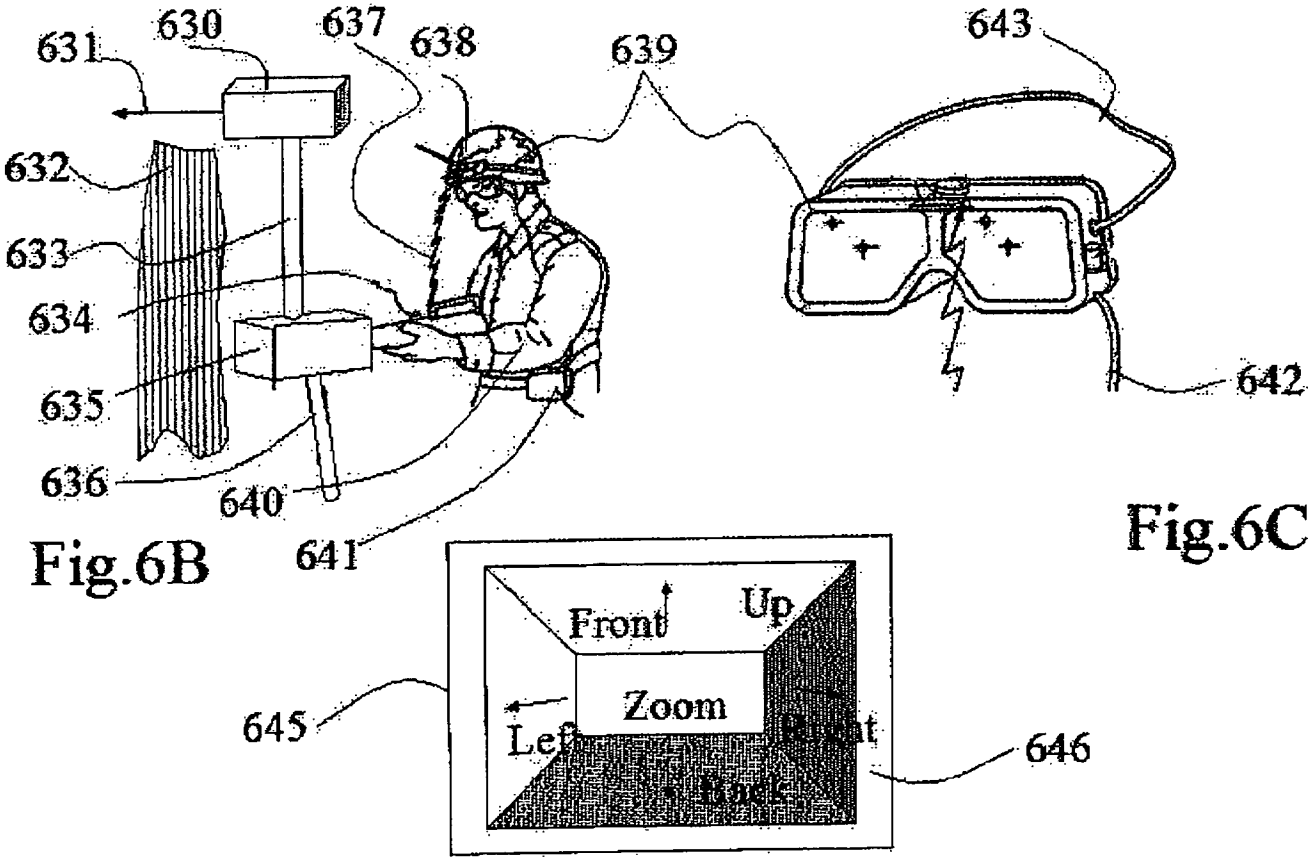
FIG. 6B represents the shooter's firing behind a shielding obstacle using his advanced visualization and shooting system another embodiment of the present invention
FIG. 6C represents the shooter's advanced goggle visualization system another attachment to the present device
FIG. 6D represents the gunner advanced visualization remote system another attachment to the present device

FIG. 6B represents the gunner advanced visualization system another attachment to the present device, that has the advantage of protecting shooter's eyes against enemy laser eye disabling shots, the camera, system being less sensitive to such aggression.

In spite Geneva treaty is prohibiting such weapons, in non-conventional wars these pieces of weaponry may be used as well.

A shooter, 640 is holding a shooting box assembly hiding behind an obstacle 632. The shooting box 630 is pointed in the target's direction 631 being elevated over the obstacle on a telescopic atm 633 from a connection box 635, that can be supported on hand 640 extension 634 or on a ground rest 636. The shooter receives the image in his goggles 639 via a cable or wireless connection 637 and is possible to be transmitted in an application network via his embedded computer 641 with communication capabilities.

FIG. 6C represents a detail of shooter's visualization system, that transmits a stereoscopic image to stereoscopic goggles 639 put on head with the cord 643 and connected to electronics box by the cord 642, at shooter's selection in all directions by switching at will, or the gun-sight, and is posting warning signals from movement sensors, and other information systems it is connected with.

FIG. 6D shows a sample of image 645 of the field the shooter may see covering all his directions, and having overlapped the thermal and radar images. On the borders of the image 646 various warning and information postings are made, letting the shooter aware of any change in the field.

Figure 7A:
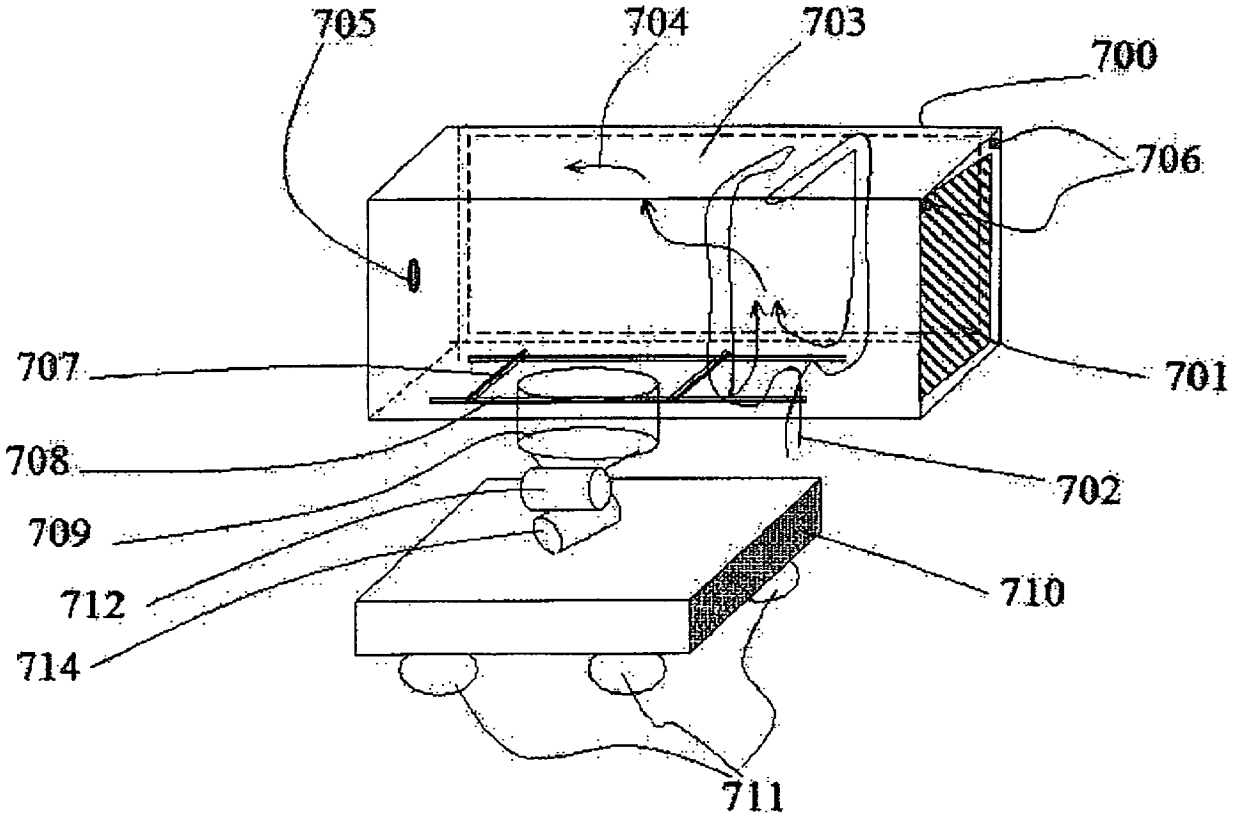
FIG. 7A shows a robotic device carrying the shooting box, another attachment device to the present invention.

FIG. 7A shows a robotic device carrying the gun in the best position another attachment device to the present invention. The device forming the shooting box 700 being light and with acceptable recoil may be transported by autonomous moving platforms 710.

The shown shooting box has the front stealth side 701 made of an imaging plate with accommodated illumination driven by the camera 705 in the opposite direction. The gun view nag the rear screen is assured by the stereoscopic camera system 706 that transmits images to the shooter video-goggles. The upper cover 703 of the box has a camouflage in interior showing the ground level thermal image assured by an appropriate laminar air flow 702-704. As previously stated during the shooting process the box stabilization is made by a system of x direction slides 708 and y direction slides 707 with respect to the shooting camera 700 coordinates and a z suspension 709 with capability to rotate around the z axis 709. The tilt after x 714 and after y axis 712 is assured by other 2 actuators, in total having another 6 freedom degrees added supplementary to the inside 2 degrees used for shouting corrections mainly. In more elaborated version it is possible to reduce the all 8 degrees of freedom to the only 2 degrees of freedom needed for firing with a more accurate system and more powerful computing system. All the system is loaded on a mobile platform 710 on wheels 711 making a robotic device, that may replace a shooter in a very harm and exposed position in the battlefield.

Figure 7B:
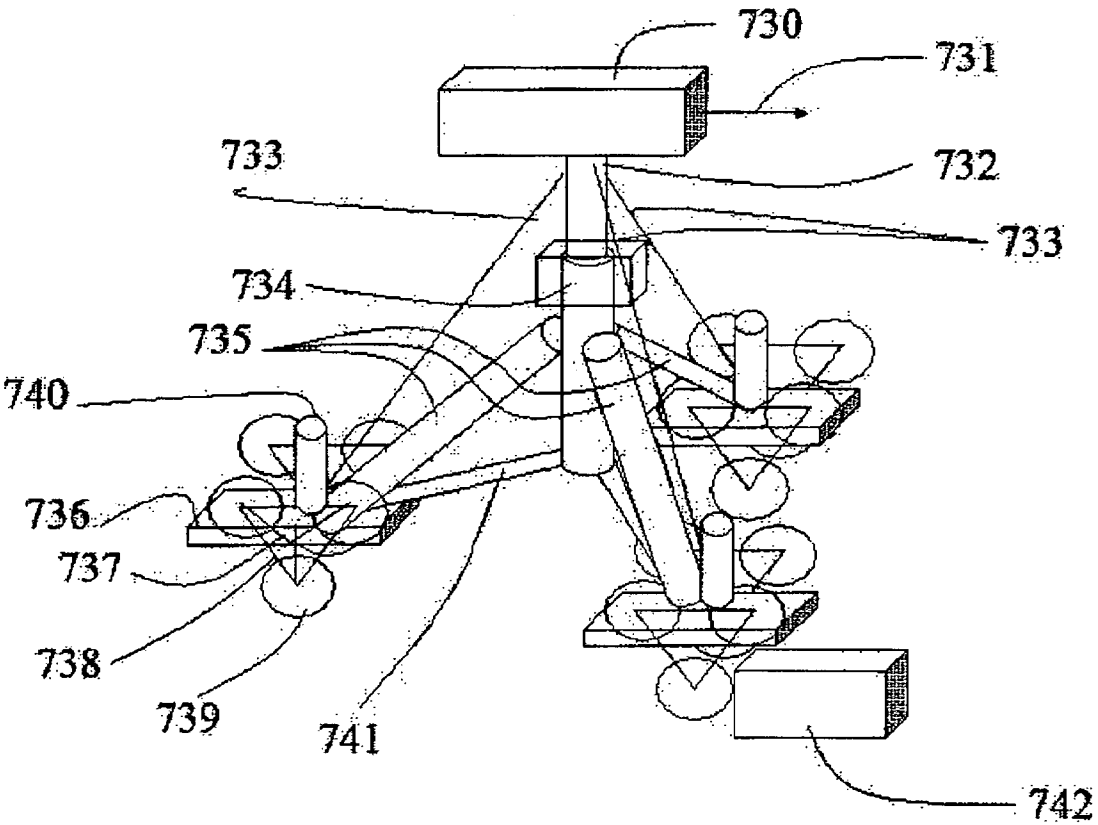
FIG. 7B shows a robotic multi-pied wheeled device carrying the remote controlled shooting box in rough terrain, another attachment device to the present invention.

FIG. 7B shows a more advanced robotic device that have the power-train split in 3 or more leg modules, creating a multi-leg stepping device with rolling capabilities 734 that holds above the shooting box 730 oriented in the firing direction 731. It is stabilized on the telescopic support 732, that can hold the box directly or the box with an extender arm as shown in FIG. 6A, holding it from the control box 612, allowing more tactical flexibility. The multipod robotic device control unit 734 controls the stepping and rolling actions and the system equilibrium, maintaining the equipments platform steady in the desired position. The displacement system is made of a number of more than 3 moving platforms 736, equipped with a set of composed wheels 737 made of a 3 wheels 739 that can move forward and backward with controlled spinning speed. When they reach an obstacle 742 the wheels spacing arms 738 are varying their distance until it is possible for the upper wheel to roll over and draw the entire platform after it. In this moment the weight force in the platform 743 will increase and the control system 734 will net to redistribute the weight among the legs in order to maintain the loads kinematics parameters by acting on the height on each moving platform adjustment 740 and the main support of the technologic platform 732. In this way the robotic system maintains its maximum necessary stability as function of operation and conditions in terrain. The control unit is supported by an assembly of telescopic arms 735, 733, 741 with functions in the system stabilization and stiffness. These kind of devices may be spread around the target from a distance, and them by themselves approaching the target and inoculating it, by remote control and local distributed computer action, being easier to solve many standoff cases and deter further street tight. Multiple shooting boxes may be added on the technologic platform, with various type of weaponry, from knife launchers, to crossbows, teasers, mortars, grenades, etc. by programming the specific launch box with the weapon details. The robotic system may have a multi-modal transportation by using an airborne system with ground and water displacement system, being easy self-deployable in tactical positions.

Figure 8A:
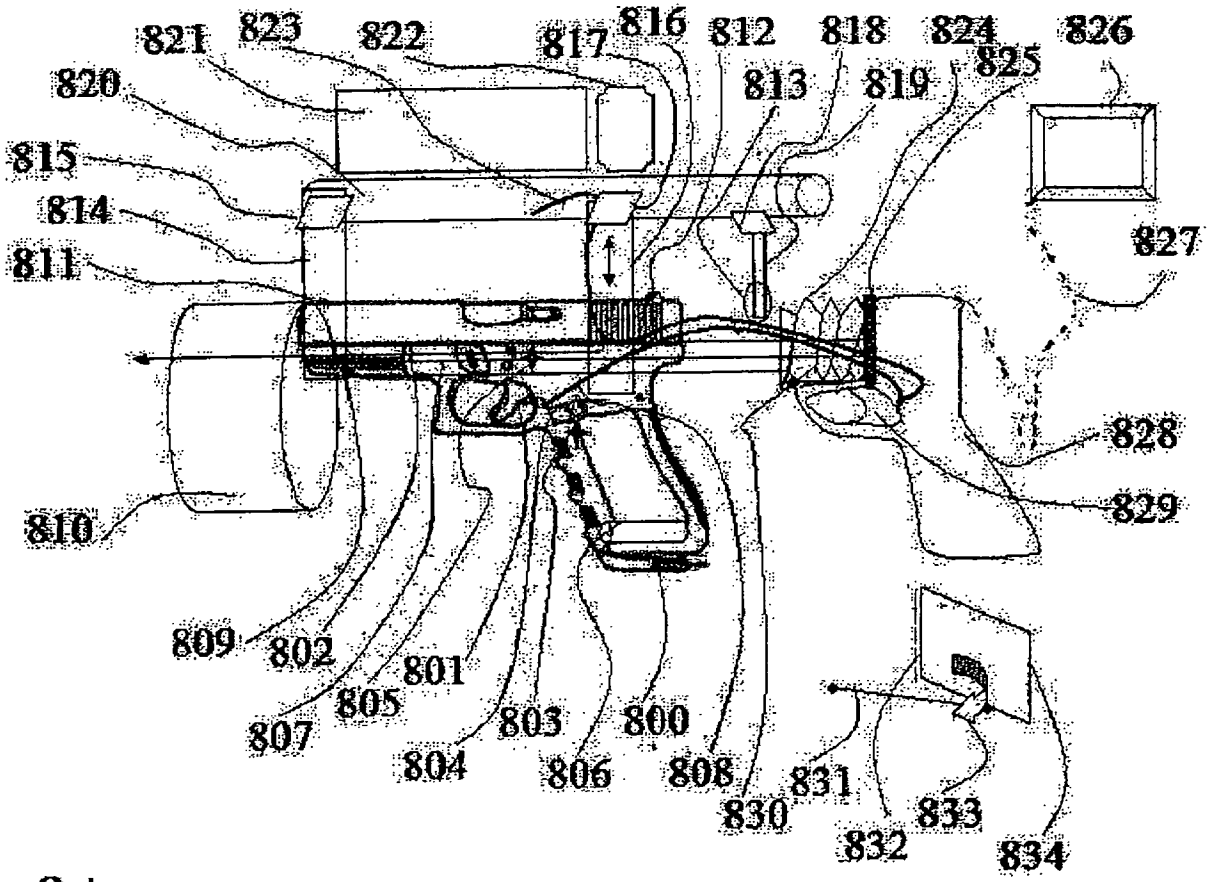
FIG. 8A shows a simplified version of the present invention, where the technologic fire control equipment is paced in part on a support rigid to gun compensating its angular recoil.

FIG. 8A shows an example of simple application of the ballistic correction system for static targets, with capabilities of shooting from behind a corner or object.

The structure has been simplified to minimum necessary to assure a high quality performance low hazard using a small arm.

The gun 800 have been gripped in two lateral armatures 807 that provide the necessary stiffness to a frame system above the gun used to install various accessories with a controllable mass in order to balance the gun's center of mass 803 when the gun is fully loaded, that may change its position migrating up to the position 804 for the gun loaded with only 1 cartridge in the firing tube and empty loader, and to displace it on the central axes of the borehole 805 in order to cancel the gun's rotation during the internal ballistics having as effect target hitting errors. With the new center of mass 805, in front of the center of application of the force on the bottom of the pressure chamber, the gun is stabilized until the bullet leaves the front cavity 810, the recoil is pushing the gun along the firing axis 802 inducing no perturbations to bullet's trajectory. Another effect previously discussed is the fringe gas effect discharging random forces on the muzzle's surface, that are stronger than the initial recoil due to internal ballistics, and deflects the gun from the firing direction making high accuracy repetitive shooting difficult. The cavity or box 810 has the role to prevent high pressure escape gases to act over the muzzle, and collects them smoothly in a special designed cavity that also filters out using a gasodynamic cyclone the unburned gunpowder and ash particulates, making the process cleaner and with less negative ecological impact. To move the center of mass the frame that surrounds the gun 802, connecting in front on the gun's rail 809 and in the back on the gun's 800 holder without covering the gun's trigger 801 that is now actuated remotely by the cable 808 that connects the new gun extender grip 828 trigger 829 to the actual gun trigger 801.

All the devices located on the upper platform are used in increasing the aiming and shooting accuracy but leaves enough room for directly using the gun's sighting system 811 and 812 in black point short range rapid firing. The platform has an articulated leg 814 that can rotate to allow the platform tilt forward. In order to adapt to the change of the mass distribution due to cartridge number and mass a parallelogram structure 815 on the front leg and on the rear leg 817 is added that smoothly changes the distance from the gun of the upper masses, to keep the assembly center of mass 805 in the right position.

The parallelograms are actuated using a control cable 823 from a control unit placed in the extension holder 828. The rear leg 816 has the possibility of varying its height in order to make the aiming platform make a controllable angle with the gun axis 802 to compensate for ballistic vertical effects. On the slide the masses may shill laterally at the rear leg level 816 in order to compensate for wind effects.

For aiming there are two visualization systems—a range finder monocular system 821 with IR vision capability, and a camera with magnification 813, placed on a support 819 connected with a center of mass adjustment displacement compensator 818, that maintains the camera 813 on the axis of the gun sight system 812 the rear sight and 811 the front sight. It also may contain a laser 820 and batteries, but all with controlled weight in harmony with the gun 800. On the support a weather station 822 may be added, to measure wind speed, pressure and temperature.

The holder system uses a recoil dumper 824 connected at an adaptor plate 825 that is underneath continued with an extension 830. This plate 825 may allow the connection of a gun holder 828, having controls attached and a remote display 826 for visualization of the images data and tiring adjustments connected via a flexible cable 827 that may be an electric wire, optical cable, or WiFi, but the last one is more sensitive to detection and jamming, in spite is wireless.

On the adaptor plate 825 may be interlaced extenders 834 connected to the plate by a hinge 832, that allows rotation 833 in horizontal or vertical plane and bending angle stabilization by the rod 831 connected to the support 830, setting the bending angle and making it stiff after adjustment. Several such extenders may be connected in series under various angles allowing increased mobility in shooting from behind shielding obstacles.

All the necessary adjustments are possible to be achieved via remote control cables or servo-actuators. The present accessories have the role to extend the usage of small guns in the domain we now use the riffles, in order to make the Special Forces more effective with minimum weaponry weight to carry in the combat terrain, all the present system being modular and easy to assembly in the battlefield.

Figure 8B:
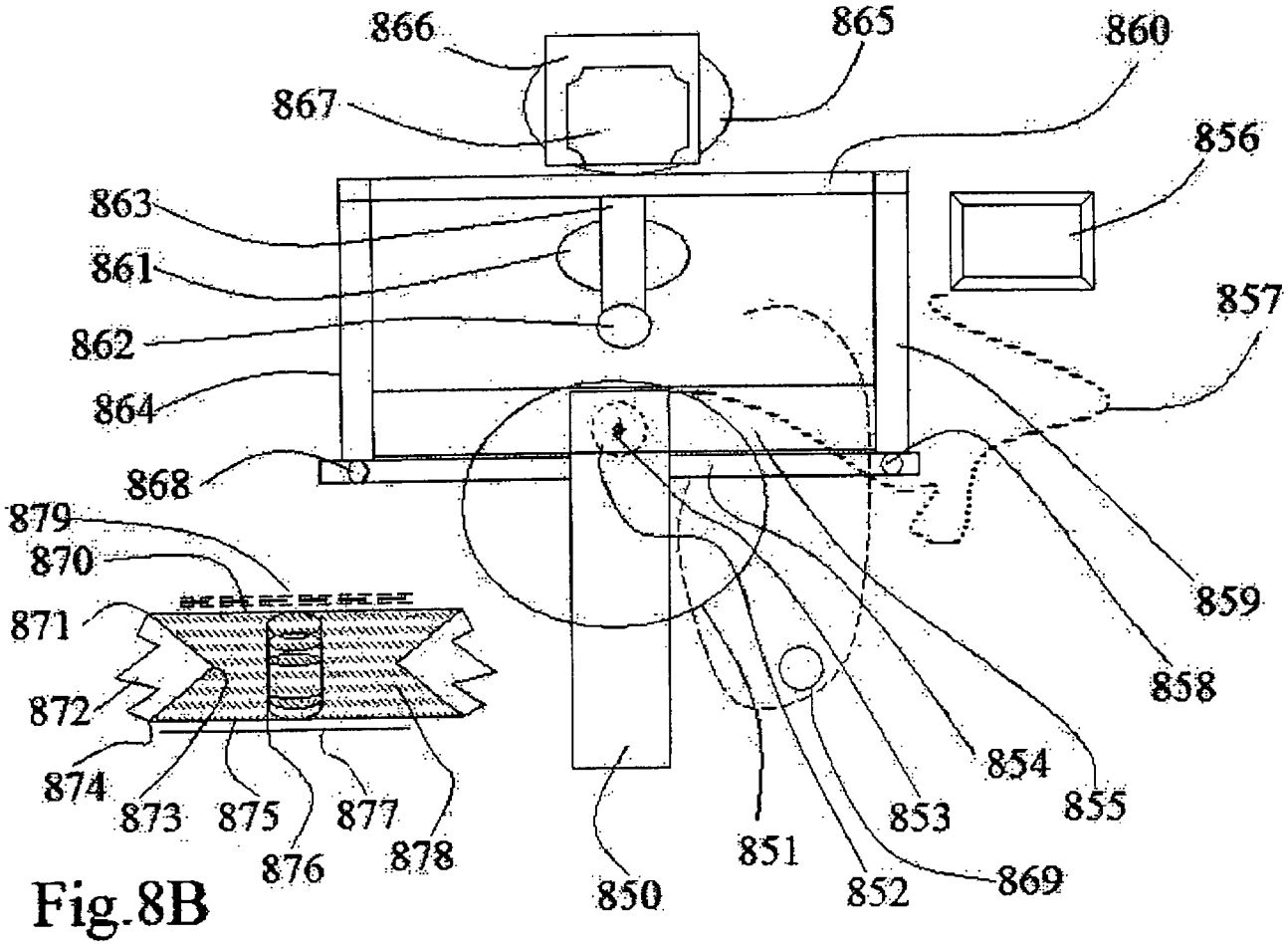
FIG. 8B shows a schematic view from the rear of the simplified shooting device another embodiment to the present invention.

FIG. 8B shows a view from behind of the reduced system from FIG. 8A, where the gun holder 828 is not installed. The handgun 850 previously 800 is shown from the back. In front it has the muzzle recoil prevention box 851 and in dashed line is figured the gun barrel 852, and in its center or the axis of the borehole 853 is placed the system center amass, in front of the cartridge, in order that the recoil to provide a stable dynamic system, having the recoil vector aligned with the bullet's propagation axis.

The gun 850 is hold by means of two pairs of clamps 854 one in the back and one in front having adjustment axis 858 and 868 used to bring the center of mass lateral deviation used for hand customized guns in the center by inserting balance weights inside.

The vertical arms 364 and 859 have adjustable height and the exact values depend of the type of equipment used. The upper horizontal platform 860 is hosting only enough shock resistant equipment with the weight enough to bring the center of mass in the center of the borehole 853. On the top platform may be installed the range finder 865, the battery pack 866, the weather station 867, and the illumination laser 861. On an adjustable length arm 863 is placed a camera used for gun vision and aiming 862, that may be attached directly or via a aiming periscope and beam splitter optics, to be used directly by the shooter or via the camera system. The camera is transferring the image to a screen 856 via a cable 857. Laterally to the gun a empty-cartridge collector 869 is attached supported on an extender arm from the gun connection plate 855, figured in FIG. 8B as 830, but the collector sachet was not figured being behind the gun and being possible to be shaped in multiple ways.

The present construction is using a sponge cheap recoil-shock absorber 855 identified in FIG. 8A as 824 made of a sponge absorber with a central spring for coming back in the extended position, shown in upper view detail. The gun frame connection 870, is made of a plate having the role to connect the gun adaptor and contain the springs 876 and sponge 878. A hinge articulation 871, 873, 874 allows the structure to be compressed without changing its external dimensions. On the side an ornamental bellow surface 872 may be added, to make it look nice.

The gun holder universal coupling surface 875 corresponding to 825 in FIG. 8A is connected with screws to the next holder adaptor 877 identified in FIG. 8A as 834 or to the holder itself 828. In order to fine tune the center of mass, a pressure plate 879 or a 3D accelerometer set may be attached and indicate the sense of the recoil, and adjust the masses until all the recoil is brought on longitudinal direction. That assures that a double/triple tap to be performed inside the gun shooting accuracy.

Figures 9A, 9B:
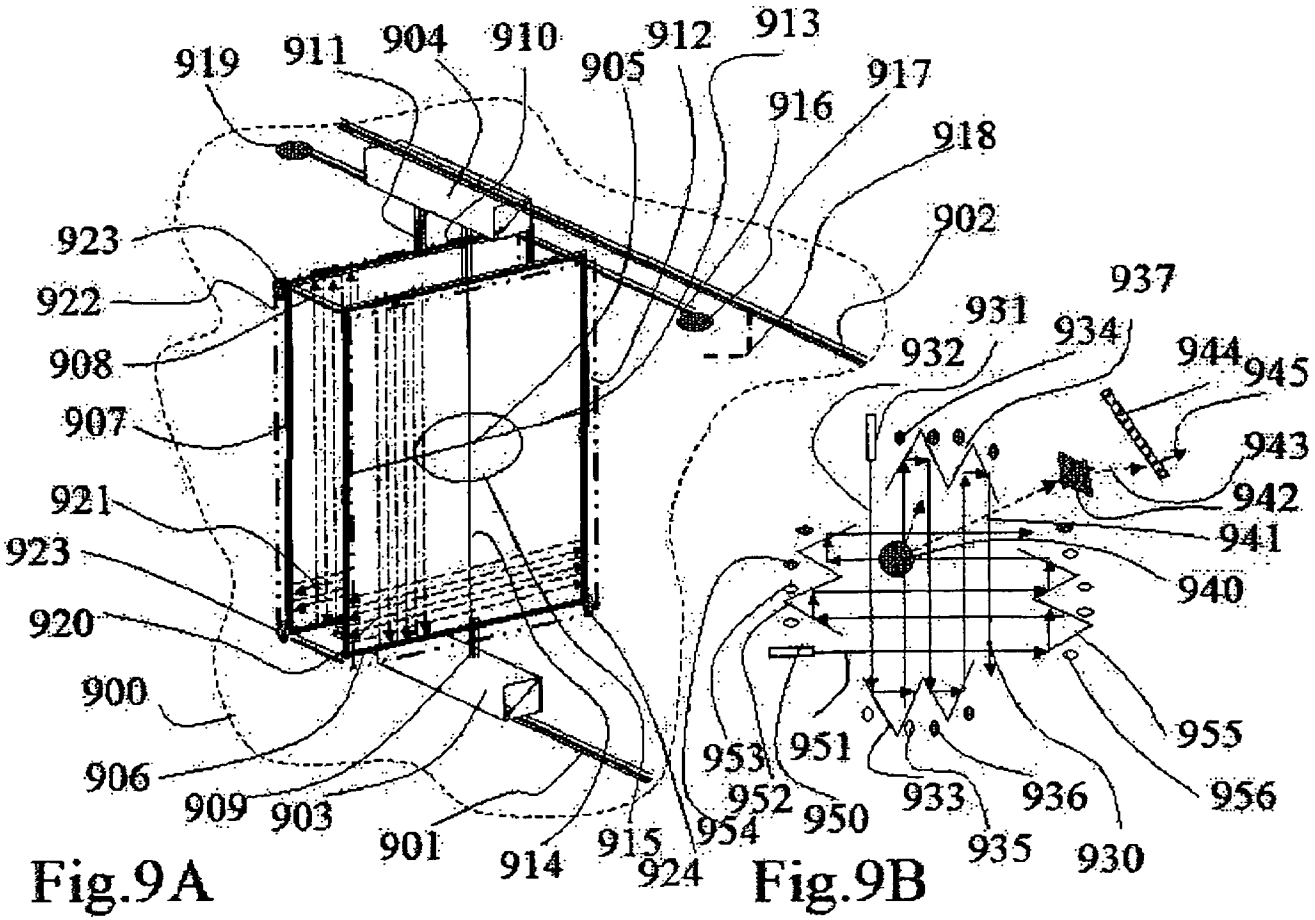
FIG. 9A shows a schematic view of a target that measures the position and velocity of the bullets being another accessory device to the present invention.
FIG. 9B shows a zoom-in of laser grid target that measures the position and velocity of the bullets being another accessory device to the present invention.

FIG. 9A shows a view of a firing accuracy measurement device, possible to be used at enhanced shooting range. The target 900 is a smart target that measures the position of the bullets and speed indicating the trajectory and shooter's position and possible the bullet's impulse at the target. Simultaneously it may measure weather conditions and fusion the data obtained from the target's computing system with the data obtained from the gun's computing system in order to determine the shooting accuracy and the ballistic calculation parameters as well as ammo's fabrication and performance dispersion. This information will be introduced in gun's calculation device and further used in tactical field. A set of these targets may be also placed in series in order to determine the ballistic evolution in several places along the trajectory in order to find the munitions-shooting accuracy dependences and reduce the MOA (minutes of angle) dispersion as much as possible, as a condition for high accuracy.

Of course the manufacturer or literature data may be used, but there are inherent mismatches due to the actual state of a gun, and large varieties of ammunition on market, that is about the same in a 10% approximation, but when more accurate performances are required the differences become visible only to the measurement, and that is this device is designed to do; to become an integral part of a system delivering shooter's safety and high quality performance.

The system that contains target accessory 900, which is placed at a shooting range, is made of a rail 901 or mad path when the measurement distance is long, or for short distances between gun an target an upper rail 902 may be used. A specialized power train 903 on the ground or 904 on the suspended upper rail is assuring the displacement of the target from the shooter's position giving the coordinates of the current position of the target, from which the target's center 905 coordinates may be deduced. The target is made of a set of frames that may be opaque when covered with a sheet of paper, fabric, mesh or solid material or transparent when are not covered being empty.

The first frame 906 is set at about 1 ft to 1 m apart from the second frame 907 by a set of spacers 908. The first frame is supported by a vertical pole 909 from the ground based power train, or 910 from the upper rail, while the secondary frame is supported by a pole 911 from the upper power train, same as for the first frame.

The frames have a special construction where a screen may be opaque, with a set of lines drawn on it vertically 914 and horizontally 913 as well as circular 915 with spacing in inch or cm. It is to be noticed that 1 inch at 100 yards subtends an angle of 0.95 MOA, is about 1 MOA with 5% approximation. The screen may have other patterns over printed on it, as body shadow, or else in order to be visible to shooter from far away. A TV camera 917 or more are placed on adjustable sticks 916 starting from the power-train, and are shielded by bullet deflective armor 918 supported from the rail 902, to minimize vibration to camera in case of bullet impact with the shield. A similar camera system 919 is placed behind the target, but shielding may not be needed due to the presence of the power train in front.

A set of parallel laser beams 920 vertical and horizontal is contained in the first frame 906 structure and a similar set of beams 921 is contained on the last frame 907, and the mode of operation is described in FIG. 9B. On the second frame 907 an extra screen frame 922 may be placed hold on sensor 923 that can measure by integration the force applied on the screen by the bullet, measuring its effective mass at the target, and impact parameters.

The same sensor system 924 may be applied on the first screen 912 to measure the force and vibration induced by the bullet's passage through. On the last screen armor shields may be placed and the shape of the force in that object may be measured as a function of bullet's stopping time, FIG. 9B shows a schematic diagram of the functionality of the target system position and velocity measurements based on a laser beams perpendicular grid 930 equivalent to 920 and 921 in FIG. 9A. The vertical beam is made of a laser 931 emitting a beam 932 in the frame plane, that reflects on a retro reflector 933 (made of semi-cubic mirrors) that reflects and shills the light 1/10" or less, making it making a parallel lines grid. When the bullet 940 is crossing the laser-beam lines grid 930 both the vertical 932 and horizontal 951 lines are interrupted and the laser light shines on the bullet 940 being reflected 941 few microseconds in the frame 906 plane into a lens 942 that sends the beam 943 into a detector barrette 944 shining on a few dots 945 that sends out the electric impulse. The horizontal grid is made of the laser 950, one at every few inches on vertical, that emits a beam 951 that reflects on the retro-reflector 955 that has a transmission of few percents and the photo detector 956 is illuminated and sends the signal on, and is shifted and travels back to the retro-reflector 952 setting on "on" the photo detectors 953 where is shifted and reflected back and so on until it meets the bullet 940 that interrupts the beam, reflecting it in other direction 941 and the next detector 954 is on 'off' and so all the detectors that follow up to the end of the module. The vertical grid is made of the laser 931 that sends the beam 932 on the opposite back-reflector 933 illuminating the photo detector 935 and setting it on "on" than reflecting back and reflecting on the opposite back reflector 937 setting on "on" or "off" the corresponding detectors. If the beam meets the bullet 940 the beam is interrupted and the next photo-detector 934 is set on "off" and so are the photo-detectors from the opposite plate 936.

This system will produce a signal of few microseconds, and from location it generates the target's coordinates the time of crossing and the length of time "off".

The system measures the speed of the bullet by dividing the distance between the two planes of detection 906 "start" and 907 "stop" to the time duration calculated by the difference between start and stop time. The duration of interruption gives the length of the bullet, while the moment of reflection and signal capture into the reflection imaging detectors gives information about the bullet's relative position while crossing that space due to gyroscopic effect.

FIG. 10A shows a schematic view of a accessory device used to balance the handgun for initial calibration of the gun balance actuators, being another accessory device embedded into the present invention.

The principle of finding and adjusting the position of the center of mass relics on the extension of the vertical lines along a hanged object that aligns with the center of mass along the hanging wire, setting itself in a stable equilibrium position. The device is simple and cheap and relies on a hook 1006 that holds a prismatic body 1002 that has a wire in the center of the bottom surface 1001 ended with a device that can be introduced in the gun's muzzle and suspend the gun of it 1000 that simply may be a cork or a more sophisticated construction that locks inside the barrel. It has to hold the weight of the gun and its center amass adjusting load. In order to simply see where the center of mass of the assembly is placed on the center axes of the gun, two balanced rulers are attached. One ruler 1004 connected by the arm 1003 to the support placed say on axis x and another ruler 1007 connected by the arm 1005 to the body 1002 and indicating the axis y.

If the body is aligned vertically it may be fixed tight in the measuring position therefore the rulers may not have to be balanced, but just simply attached. Another solution is to replace the rulers with laser lines, aligned after the string 1001 and extended downwards over the gun.

That requires two stable positions around the gun, shooting the two beams to intersect on the string and be extended below, so to estimate from the exterior if the borehole axis is touching the center of mass.

FIG. 10B shows a schematic view of a the accessory device mode of use to balance the gun assembly being another accessory device to the present invention.

The center of mass measuring device 1032 is fixed tight in a vertically aligned position using the holder 1036*k* and has the rulers 1034 and 1037 aligned along the string and aside of the gun, at an acceptable distance fixed from the horizontal displacement slides 1033 and 1035 passing through the holder's body.

The string or wire 1031 enters in the center of the cork 1030, concentric in the bun's barrel, which is pushed tight in the gun's muzzle 1029, holding it in suspension. The purpose of this operation is to find the right masses and their tight position that in any loading stage to have the center of mass aligned on the axis of the borehole. To accomplish this we will use for adjustment the pantographs 1025, in front, 1014 at the rear and 1017 at the aiming device, in order to record their position as a function of missing cartridges 1011 in the gun's ammo loader 1010. Because the handgun's holder mass, the center of mass 1026 is placed in the area between the gun's loader 1010 and gun's trigger 1028, being off gun barrel's axis, and that is generating a rotation torque during the firing. In order to move the center of mass on the gun barrel's central axis 1027 and to maintain it there no matter how many cartridges 1011 are missing from the loader 1010 an entire structure have to be attached.

The structure is made of a holder bars that holds the gun from the front rail 1029 near the muzzle and a more complex holder 1012 holding the gun grip. On these bars other vertical support tubes 1013 are holding the upper gun platform 1022. The idea is to use the mass of some useful systems, that are acceleration and shock robust and have constant mass to balance the handgun assembly and bring the center of mass from initial position 1026 in the desired position 1027, that has obvious advantages as shown in FIG. 4 and FIG. 8 functional descriptions. For this exemplification purpose the FIG. 8 simpler design was chosen. At this design adjusting the height of the rear arms 1013 that acts over the center of mass of the devices from the upper platform 1022, and tilts the instrument optical sight forward to accommodate for the ballistics requirements. The number of cartridges variation in the loader 1010 gives a slight displacement of the center of mass 1026 towards the gun barrel, whose compensation requires a smooth indexed displacement towards the gun of the upper platform. A slight movement of the upper platform 1022 holding main instrument as laser pointer/active rangefinder 1023 using the pantographs structures 1025 and 1014 compensates this slight movement.

The pantographs are driven by rods 1024 whose lengths determines the pantograph height which are driven together by a central rod 1019, set into an indexed displacement board 1019 that have to be initialized. The gun's recoil makes the position of indexing board change incrementally accommodating with cartridges number. The purpose of all this operation is to find out the right position of the rod and initialize the indexation board for the type of ammunition used. The gun sight camera 1015 that uses the gun's aiming devices hold on an adjustable support 1016 has another pantograph 1017 that acts contra variant with the upper's platform pantographs controlled by the same indexing rod 1020 with the purpose to maintain constant the initial aiming position of the camera 1015.

The indexation hoard 1018 that holds the actuating rod 1019 acting on 1024 and 1020 is automatically incremented by the recoil and may be also manually adjusted. For continuously adjusted devices using linear actuators the measurement of the best position to be introduced in control systems memory is the most important result of this operation. For each loading stage the actuator is varied until the rulers 1034 and 1037 are parallel and along the gun's barrel, meaning that the center of mass is placed in the right position 1027 and the displacement value is memorized. It is right that the recoil accelerometers detects not only the effectiveness of the cartridge performances but also center of mass misalignment, signaling the shooter that a calibration is required or some programming error was made, for example loaded cartridge are not corresponding with the initialization data given to firing control system.

This adjustment is very important for the firing accuracy, because it prevents the gun rotation during the bullet's acceleration inside the gun barrel and lithe muzzle gas fringe recoil is also suppressed the gun will shout accurately several rounds on the same direction without reaming, The automatic firing control system based on accelerometers and inertial base, will also allow that actuators automatically bring the system on the firing direction and fire without input from the shooter.

Private industry would be employed to build the many units required as accessories to the existent guns. Although the cost of high speed computing and actuating is high, being the largest part of the cost of this accessory system compensated by the labor and hazard, which would be greatly reduced. The savings in indirect costs would also be considerable, such as avoidance of exposing the shooter to enemy fire, less ammunition consumption, less wear and tear on other gun parts, avoids shooter stress, which in turn affects intervention team productivity and mental health of the workers by avoiding stress disorder syndromes due to the fact that automated remote controlled systems may be used in very hazardous situations, and on the other side, will reduce dramatically the number of causalities being a strong deterrent for criminals to expose to high denial danger, most of the situations ending by surrender.

Examples of the Invention

Thus it will be appreciated by those skilled in the art that the present invention is not restricted to the particular preferred embodiments described with reference to the drawings, and that variations may be made therein without departing from the scope of the present invention as defined in the appended claims and equivalents thereof. The present invention consists in development of a set of accessories to equip a handgun that will extend its range and accuracy by an order of magnitude, and usual street conditions battle wider the range of 1000 m will be doable using handguns only instead of the actual assault rifles. The application of these customized accessories to rifles will bring their usability range up to 3 Km almost equivalent to the actual specialized rifles used by snipers, but much cheaper and accurate, requiring shooter just clearly identify and aim the target, letting the automated system to perform the firing. All the actual adjustment procedure taking more than 10 seconds to a professional sniper will be performed by the automated system at a fraction of a second immediately after the final aiming. The invention will may be also applied in very complex situations, allowing the shooter to stay behind shielding obstacles and use the telescopic arm to place the gun in the best shooting position, make the gun stealth for day or night scenes, and even making possible the use of robotic systems to approach a dangerous target, prone to kamikaze actions. The accessories may be applied to a large number of weapons after necessary customization, from blade throwers, to arrow thrower/launchers, teasers, compressed air, bullets with chemical propulsion, RPGs, or rail guns. The use of the shooting box applied on mobile platforms will commit the first step to human's replacement in the war, by using these devices that makes the basic function of a human soldier—field observation and control by shooting enemy targets.

What is claimed is:

1. A ballistic thrower/launcher accessory device comprising:

a ballistic launcher accessory device comprising:

a stabilization system including:

a center of mass adjustment sub-system having means to set and maintain a center of mass of a launcher at a position that minimizes or cancels components of recoil that are perpendicular to a trajectory of a projectile to be launched from the launcher, comprising:

a grip providing a stable platform on two axes perpendicular to the projectile trajectory and allowing movement along a first set of rails on an axis parallel to the projectile trajectory;

a set of weights correcting for change in center of mass by expending of ammunition;

a recoil damping sub-system, including:

a second set of rails, allowing arms attached to the launcher to slide along the second set of rails due to recoil;

a set of recoil absorbing bumpers in contact with the arms, and consisting of either: pairs of bellows with interconnecting calibrated orifices to allow a controlled rate of gas flow between bellows in each individual pair of bellow, or compressible materials;

a set of springs that brings the launcher back into operating position;

a vortex device to separate post combustion solid particles from exhaust gases used to propel the projectile, depositing the separated particles in a collector and channeling the gases through the bellows and dampening recoil introduced in a muzzle of the launcher;

wherein said second set of rails are connected to a frame that is further connected to a throwing angle adjustment sub-system;

a set of sensors providing recoil force information to a computer programmed to analyze launch parameters;

a camera connected to the frame optically aligned with an aiming sight, the camera further including zoom and transmission capabilities, the transmission capability for transmitting a sighting image to a remote display;

the throwing angle adjustment sub-system including means to rotate the recoil frame in a horizontal plane and a vertical plane further including:

a ballistic adjusting frame connected to the recoil frame with a first angle sensor and a first actuator, the first actuator providing vertical rotation about a center of mass of the recoil frame at an exit point of the projectile on the recoil frame;

a rotation adjusting frame connected to the ballistic adjusting frame with a second angle sensor and a second actuator, the second actuator providing horizontal rotation about the recoil frame center of mass or the exit point of the recoil frame;

a vibration and unintentional movement during launching process cancellation device comprising a set of perpendicularly actuated slides;

an external camouflage box, equipped with:

a. a set of movement sensors;

b. active imaging devices including a set of security cameras that monitor launcher environment and send a processed signal via a computer to display panels that cover the box;

c. a set of temperature measurement sensors that send a signal to a temperature control system;

d. a set of sound, radar, laser and light measurement instruments for monitoring the environment surrounding the launcher;

e. communication and computing instruments;

a target aiming and ballistics control sub-system comprising:

a launcher-sight visualization system utilizing the camera connected to the recoil-frame and the remote display;

an active range finder projecting a laser beam on a target, where the laser is placed near the launcher-sight camera;

a passive range finder utilizing a set of two cameras of the active imaging devices of the external box, and disposed externally of the box, each camera of the set of cameras including angle sensors and being rotatable in the horizontal plane by a camera actuator, wherein information generated by the angle sensors is sent to a calculator to find a range to the target;

a weather station, disposed externally on the external box, that measures parameters influencing projectile ballistics;

a ballistics calculator, that calculates ballistic trajectory angles;

a target and launcher movement calculator for calculating an anticipated launching position, wherein the movement calculator works in combination with the ballistics calculator, and wherein the calculators are disposed in a specialized box and capable of receiving input from an operator;

an operator grip having two buttons, a first button to trigger target data acquisition and a second button for projectile release;

a throwing quality assurance sub-system that calculates target hit probability and selects a number of projectiles to be launched using recoil force measurement data from sensors;

operator goggles capable of displaying information regarding the target and a perimeter of the environment, the goggles combining the image from the launcher-sight camera with other signals coming from the environment monitoring cameras, sensors and instruments;

an operator's protection sub-system, comprising:

a telescopic, articulated arm holder that allows an operator to take shelter, find and use safe positions, while positioning the launcher in an appropriate operating position;

a mounting adaptor to mount the device to a robotic transporter, the transporter having remote control capabilities for launcher and transporter, and operated remotely;

a second passive target range finder, made of a second set of two cameras aiming at the target placed at a lateral distance apart;

a launcher camouflage sub-system that further includes:

throwing-noise, vibration and light emission damping using the vortex device, and camouflage box shielding;

camouflage-box surface temperature adjustment to minimize Infra-Red visibility using internal cooling flow by collecting heat and released gases and ventilating the gases via a hose at ground level;

visible spectrum camouflage using cameras from the active imaging devices and displaying the image seen by a camera placed on a lateral side of the camouflage box on a display placed on an opposite side of the box, adjusting display brightness to an illumination level similar to that of the surrounding environment;

an odor reducing system, using a ventilation system that mixes gas released from the launching device with fresh air;

a detection system for enemy presence in the surrounding environment that includes:

a set of external movement and sound detectors placed on or within the camouflage box;

cameras of the active imaging device that are placed all around the launching device and operator, with visualization on the remote display or goggles;

a communication system for communicating with other operators in the field or remotely;

an enemy's range finder detection system using a laser pulse detector placed on or within camouflage box;

an operational battlefield integration sub-system comprising:

a computer network communication interface with remote operators or centers for field data sharing and data integration;

auxiliary equipment that comprises:

a launcher balancing system that is used for adjusting the center of mass of the launcher by determining positions on arms of each weight of the set of weights used to balance the launcher; and, a plurality of target frame pairs using laser beams to measure moment, position and speed of a projectile crossing the frame, and using weather parameters at the target position in order to calibrate the launcher's action and obtain ballistic information.

2. The device according to claim 1, wherein the recoil dampers are made of bellows compressing the air at a rear of a launcher slide, forcing the air in the cooling system and making a vacuum at a front used to increase aspiration of propellant gas in the vortex device.

3. The device according to claim 1, wherein the passive range finder uses the set of two cameras to measure a tilt angle between the two cameras that derives an image of the target by overlapping images from each one of the two cameras to measure a distance to the target, wherein the image from the launcher aiming sight camera is transmitted to the operator goggles.

4. The device according to claim 1, wherein muzzle recoil is eliminated by using a specialized chamber that splits a propelling gas flow burst into fractions thereof and centrifuges the fractions to separate the gas from solid particles and recombines the fractions in a directed exhaust, creating a destructive interference among delayed shock waves of the fractions.

5. The device according to claim 1, wherein an exterior of the launcher is made less visible in Infra-Red and visible spectra using controlled airflow that brings the exterior of the camouflage box to an ambient environment temperature and removes generated heat of electronics and throwing device using a hose to drive down the exhaust gas to the ground mixing the gases with atmospheric air to reduce Infra-Red glow.

6. The device according to claim 1, wherein a computer controlled actuator system is used to perform projectile release, and wherein the operator performs aiming and authorization for projectile throwing/launching.

7. The device according to claim 1, wherein a computer sub-system calculates and predicts a position of a target and best projectile release angles based on using an equation of movement and ballistic equation.

8. The device according to claim 1, wherein performance of projectile propellants and accuracy of inertial correction of the stabilization system is continuously measured and evaluated in order to calculate a probability of hitting a target and to decide upon multiple projectile launching as soon the launcher is reloaded.

9. The device according to claim 1, wherein the launcher is mounted inside the external box and the box is supported by an arm extender including several joints and hinges that allows the operator to take shelter at an optimal distance from an edge of a shielding object.

10. The device according to claim 1, capable of use with any ballistic launcher, selected from a group consisting of: bows, crossbows, compressed air launchers, electro-magnetic launchers and chemical impulse propulsion launchers.

11. The device according to claim 1, further using an inertial base and an actuator system to maintain a position of the external box for an interval of time elapsed from a previous aiming to an effective projectile release in order to preserve accuracy and avoid any change due to hand inaccuracy, vibrations, or other unintentional movements during a time interval elapsing from triggering of projectile launch until launch operation is accomplished.

12. The accessory device according to claim 1, that is customizable based on application requirements and capable of containing fewer sub-systems.

13. An accessory device for ballistic thrower/launcher comprising:

a. a center of mass balancing system that forms a solid body with a launcher having a position of weights adjustable such as to compensate for variation of number of projectiles in magazine;

b. a system for variation of masses position based on a double pantograph structure actuated simultaneously in opposite directions in indexed positions as a function of number of projectiles in the magazine;

c. a camera having an optical axis aligned with a launcher's target sight placed on launcher adaptor;

d. a muzzle recoil reducer for launchers with chemical propellant made of a special labyrinth box, which box splits gas pressure shock wave into wavelets, each wavelet delayed differently in the box and filtrates exhaust gases using a vortex separator and eliminates the gases via a suction and mixing system far from the launcher;

e. a system made of shock absorbing materials placed behind the launcher;

f. a set of intermediary, adjusting and locking hinges;

g. a set of modular arm extenders with connectors;

h. a weather and inertial station mounted on the launcher;

i. a set of cameras for range finding and target sighting connected to a mobile monitor screen or headset;

j. an Infra-Red laser pulse range finder; and, k. a ballistic calculator and a target position calculator that control projectile release actuators and adjust a sighting system with respect to the launcher, forcing an operator to adapt a position of aiming and throwing.

14. The accessory device according claim 13, further comprising a balancing system used to hang the launcher in order to determine a center of mass of the launcher.

15. A method to improve an effective range of a ballistic thrower/launcher comprising:

attaching an appropriate center of mass balancing sub-system to a ballistic launcher including hanging the launcher from a projectile exit point and moving mobile weights until a center of mass of the launcher is placed on a central trajectory axis;

using the center of mass balancing sub-system and finding positions of the mobile weights that correspond to each number of projectiles stored in a magazine of the launcher to maintain center of mass on the central trajectory axis;

when parameters of a selected projectile are known, the parameters are introduced into a ballistic calculator, but when the parameters are unknown, an operator determines the parameters using a projectile performances measurement sub-system; the launcher to be tested with selected projectiles and calibrated prior to an action using the center of mass balancing sub-system;

installing the launcher with the balancing sub-system in an accessory device, that includes means for reducing recoil, means for improving throwing accuracy, means for assuring operator's safety and security, means for assuring quality of operation, and an electronic sub-system having measurement, calculation and communication capabilities;

using the launcher in a battle/tactical field including the steps of:

initializing the electronic sub-system wherein a Global Positioning System and/or an inertial base reference is set, and wherein weather and environmental data is acquired;

approaching a target and selecting a range finder to use depending on how sensitive the target is to activated devices and electromagnetic communication;

when the target is opponent sensitive, using a dual-camera range-finder;

when the target is not opponent sensitive, using an Infra-Red laser range finder, and communication via radio waves;

a ballistic calculator sub-system displays a target range and indicates a probability of hitting the target, with a selected projectile, based on ballistic data;

checking for enemies in a nearby area and evaluating potential places from which enemy observation is possible, and tuning an image camouflage system;

in an active combat area, taking shelter and using an articulated arm to place the launcher in a proper operating position and to keep the operator in a safe position;

when the operator decides to engage the target, aiming at the target several times using short time intervals and after several aims, allowing projectile release and remaining steady;

performing the launching process and measuring performance of projectile launch, estimating hitting probability and deciding whether to immediately release more projectiles;

engaging another target or leaving the area, checking for potential enemy presence;

shutting down electronic sub-system and pack the launcher and its accessory device;

after action, checking the ballistic parameters of the launcher using a projectile performances measurement sub-system in order to acquire the ballistic parameters, applying maintenance and storing as "ready to use".

* * * * *